US011337001B2

(12) United States Patent
Nelson et al.

(10) Patent No.: US 11,337,001 B2
(45) Date of Patent: May 17, 2022

(54) SOUND REPRODUCTION

(71) Applicant: ADAPTIVE AUDIO LIMITED, Hampshire (GB)

(72) Inventors: Philip Nelson, Hampshire (GB); Takashi Takeuchi, Hampshire (GB)

(73) Assignee: ADAPTIVE AUDIO LIMITED, Hampshire (GB)

( * ) Notice: Subject to any disclaimer, the term of this patent is extended or adjusted under 35 U.S.C. 154(b) by 0 days.

(21) Appl. No.: 16/952,623

(22) Filed: Nov. 19, 2020

(65) Prior Publication Data

US 2021/0152938 A1 May 20, 2021

(30) Foreign Application Priority Data

Nov. 19, 2019 (GB) ..... 1916857.4

(51) Int. Cl.

| | |
|---|---|
| ***H04R 25/00*** | (2006.01) |
| ***H04R 3/12*** | (2006.01) |
| ***H04R 1/20*** | (2006.01) |
| ***H04S 7/00*** | (2006.01) |
| ***H04S 1/00*** | (2006.01) |
| ***H04R 3/04*** | (2006.01) |
| *H04R 5/02* | (2006.01) |

(52) U.S. Cl.
CPC ..... *H04R 3/12* (2013.01); *H04R 1/20* (2013.01); *H04R 3/04* (2013.01); *H04S 1/002* (2013.01); *H04S 7/30* (2013.01); *H04S 2420/01* (2013.01)

(58) Field of Classification Search
CPC .... H04R 3/12; H04R 1/20; H04R 3/04; H04S 1/002; H04S 7/30; H04S 2420/01
USPC ..... 381/310, 307, 300
See application file for complete search history.

(56) References Cited

U.S. PATENT DOCUMENTS

2010/0202629 A1* 8/2010 Takeuchi ..... H04S 5/00 381/98

FOREIGN PATENT DOCUMENTS

| | | |
|---|---|---|
| JP | 2008-99122 | 4/2008 |
| WO | 2016/131471 | 8/2016 |
| WO | 2017/030920 | 2/2017 |
| WO | 2017/158338 | 9/2017 |

OTHER PUBLICATIONS

Search Report issued by UK Intellectual Property Office in corresponding UK Application No. GB1916857.4 dated May 19, 2021.

* cited by examiner

*Primary Examiner* — Ammar T Hamid
(74) *Attorney, Agent, or Firm* — Whiteford, Taylor & Preston, LLP; Peter J. Davis

(57) ABSTRACT

A signal processor for a sound reproduction system which is arranged to perform processing of a sound recording so as to provide input signals for an array of distributed loudspeakers, such that the sound field generated by the loudspeakers results in cross-talk cancellation in respect of multiple listener positions at substantially all frequencies reproduced by the loudspeakers, and wherein the sound field so generated is an approximation of a sound field produced by an Optimal Source Distribution, OSD.

19 Claims, 19 Drawing Sheets

OPTIMAL SOURCE DISTRIBUTION FOR MULTIPLE LISTENER VIRTUAL SOUND IMAGING : FIGURES

Geometry of the two source-single listener arrangement. The two sources are spaced apart by a horizontal distance $d$.

OPTIMAL SOURCE DISTRIBUTION FOR MULTIPLE LISTENER VIRTUAL SOUND IMAGING : FIGURES
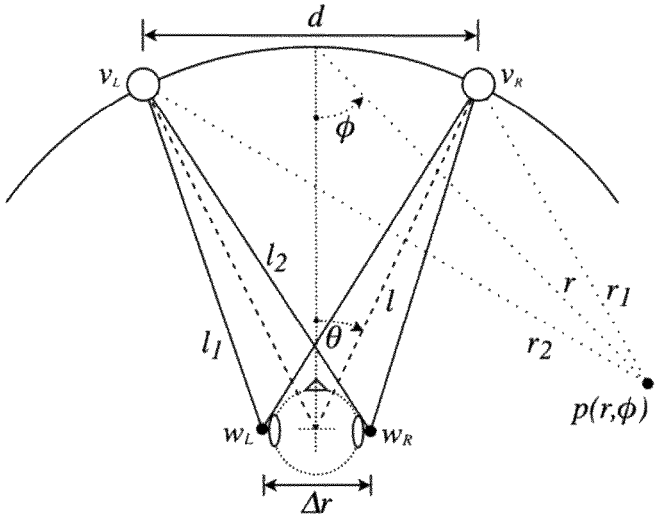
Figure 1. Geometry of the two source-single listener arrangement. The two sources are spaced apart by a horizontal distance $d$.
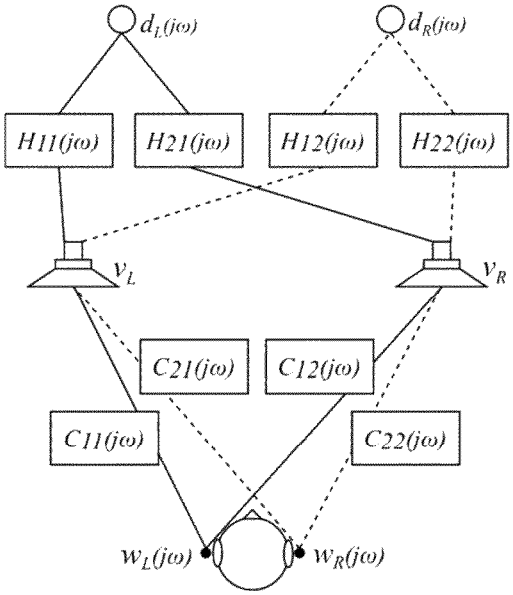
Figure 2. Equivalent block diagram describing the source-listener arrangement in

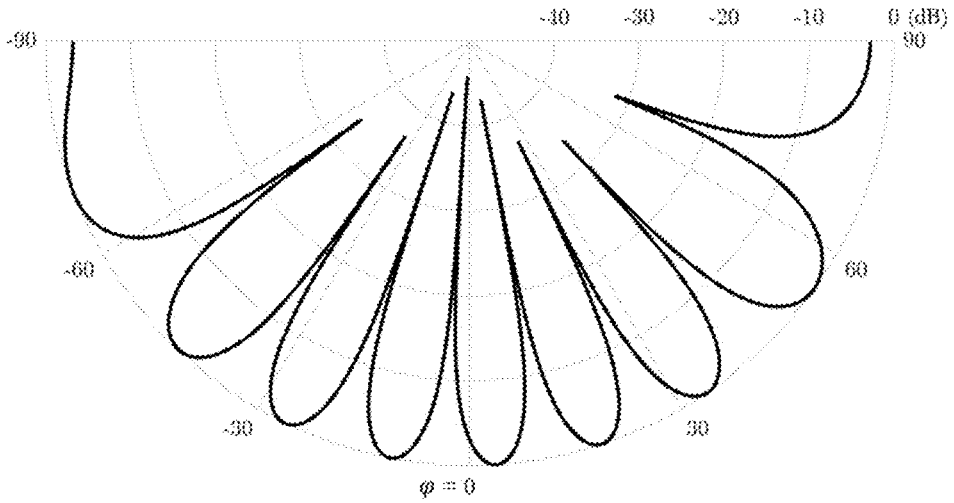
Figure 3. Directivity of the Optimal Source Distribution, showing the far field radiation pattern on a decibel scale as a function of the angle $\varphi$.
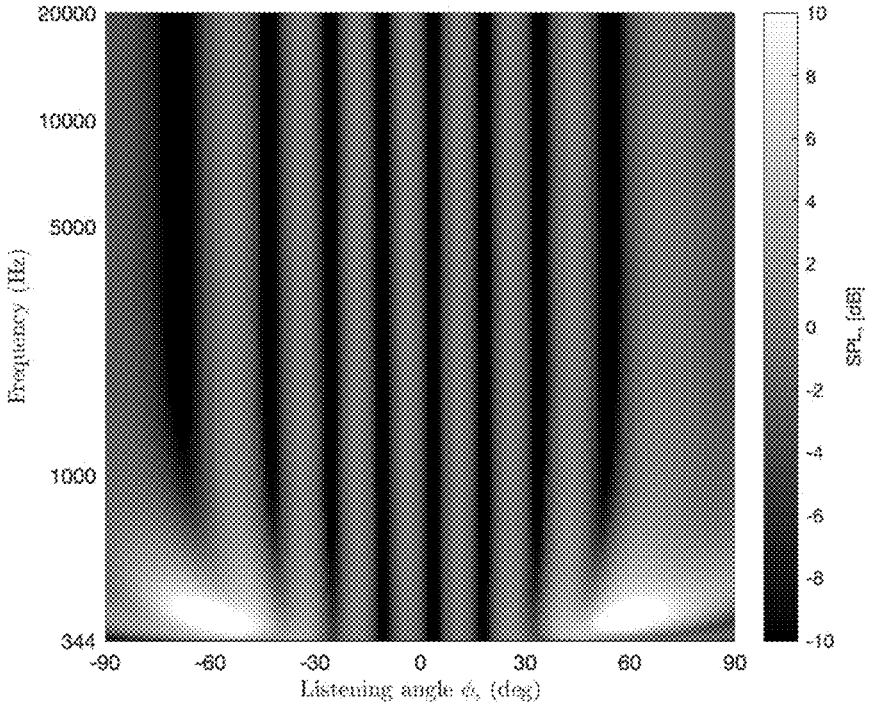
Figure 4. The interference pattern produced by the 2-Channel OSD as a function of the angle $\varphi$ (horizontal axis) and frequency (vertical axis)

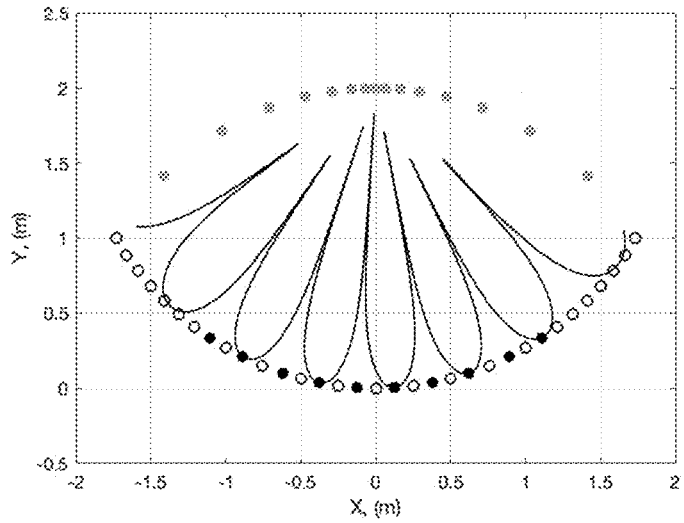

Figure 5. The arrangement of $M$ point sources (grey symbols) and $L$ points in the sound field at which the complex sound pressure is sampled. Cross-talk cancellation is desired at $P$ points (black symbols) whilst a least squares fit to the OSD sound field is desired at $L - P = N$ points (white symbols).

| Source Angle $\theta$ (deg) | 2CH OSD Frequency (Hz) |
|---|---|
| 45.00 | 487 |
| 36.27 | 582 |
| 29.06 | 709 |
| 23.12 | 878 |
| 18.21 | 1103 |
| 14.16 | 1409 |
| 10.81 | 1837 |
| 8.05 | 2461 |
| 5.77 | 3427 |
| 3.89 | 5079 |
| 2.34 | 8445 |
| 1.06 | 18673 |

Figure 6. The angles $\theta$ defining the positions of the sources and the optimal frequency at which the path-length difference from each source to the listener's ears is $\lambda/4$

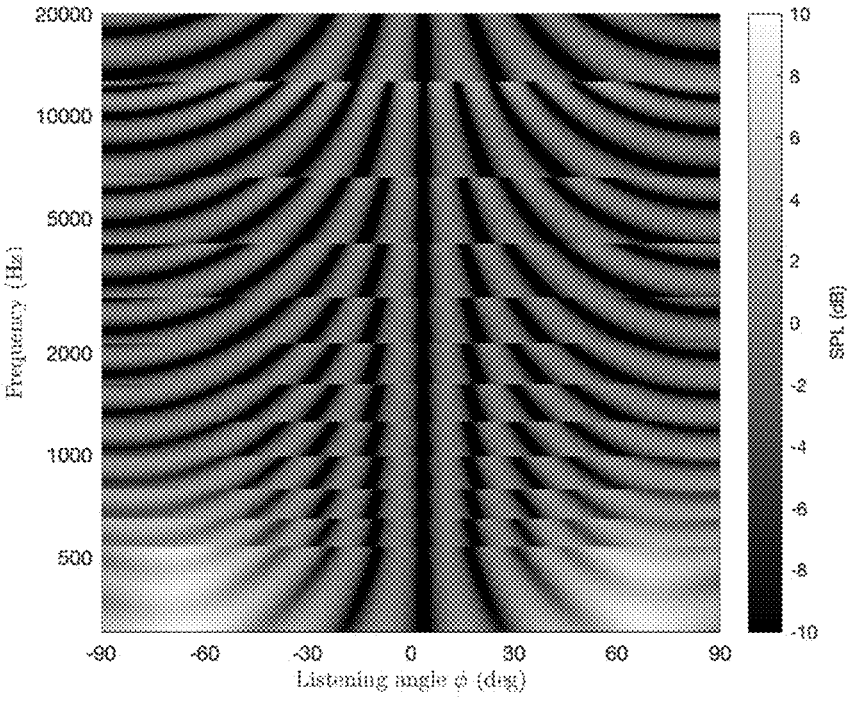
Figure 7. The interference pattern produced by the multiple pairs of sources at the positions defined in Figure 6 as a function of the angle $\varphi$ and frequency.
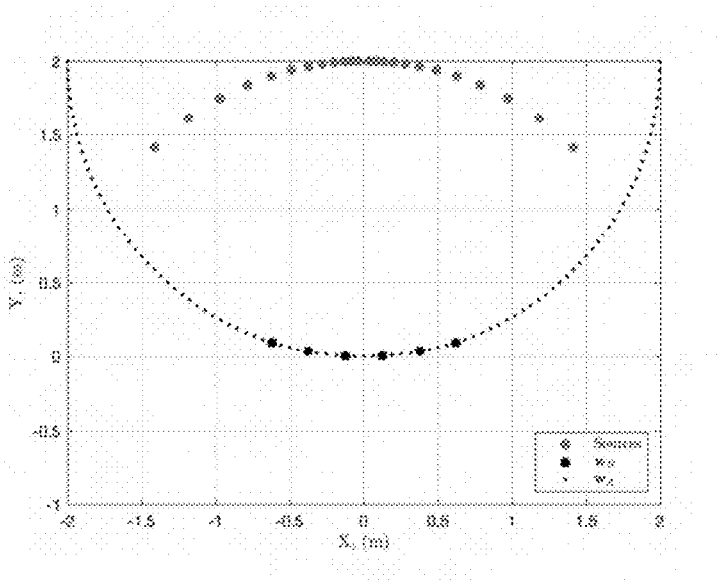
Figure 8. Positions of three listeners in the sound field well-aligned to the OSD interference pattern "Case 1"

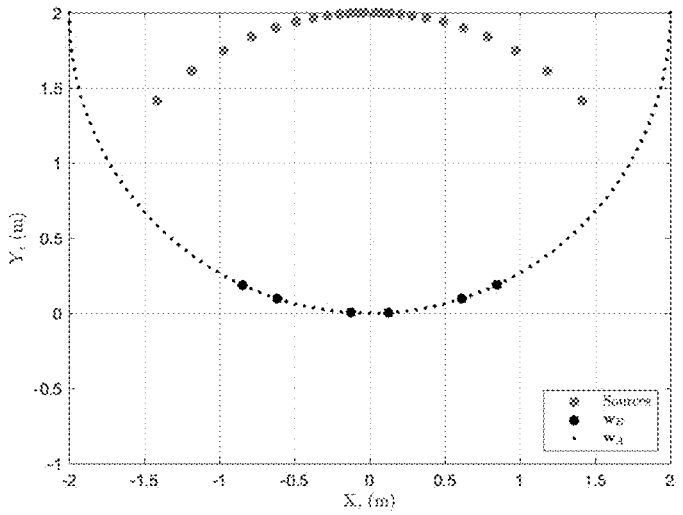
Figure 9. Positions of three listeners in the sound field not well-aligned to the OSD interference pattern ("Case 2")
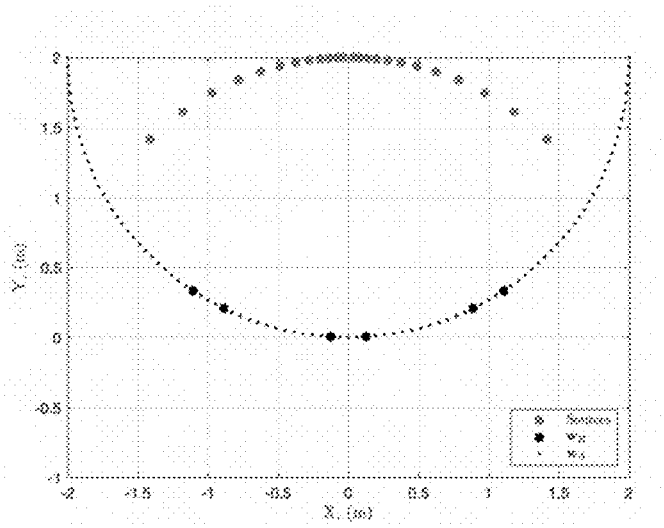
Figure 10. Positions of three listeners in the sound field well-aligned to the OSD interference pattern ("Case 3")

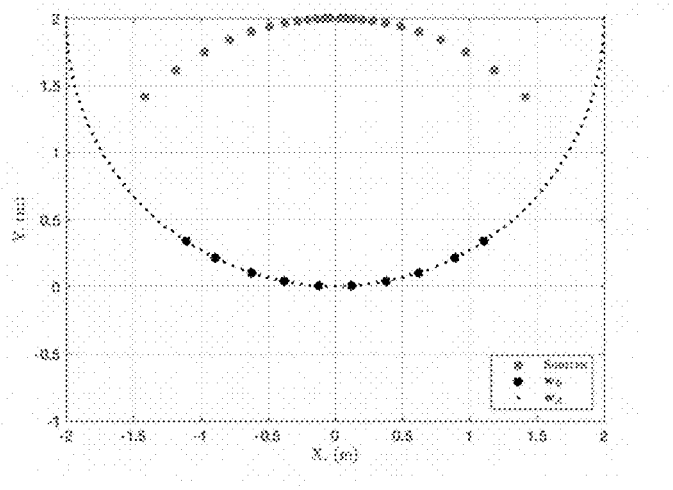
Figure 11. Positions of five listeners in the sound field well-aligned to the OSD interference pattern ("Case 4")
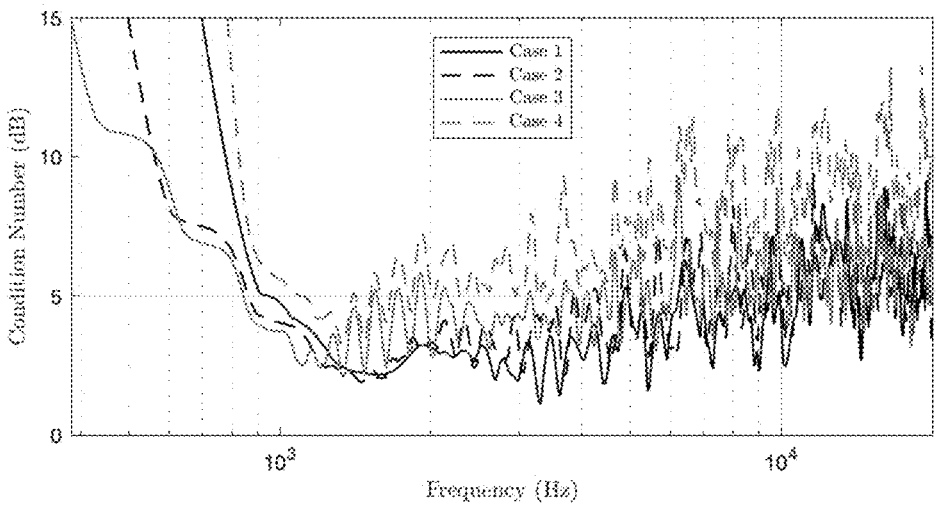
Figure 12. The condition number of the matrix B for the four geometries depicted in Figures 8-11 above.

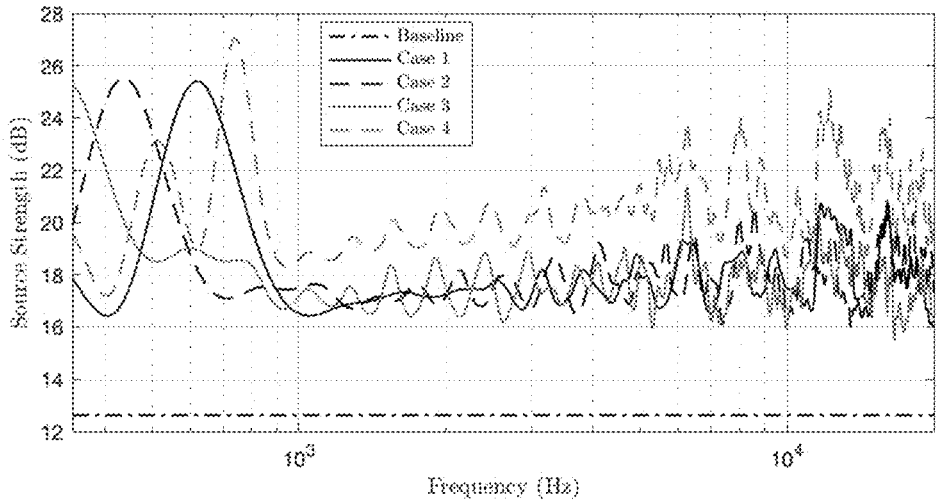

Figure 13. The sum of squared source strengths $\mathbf{v}_{opt}{}^{\mathrm{H}}\mathbf{v}_{opt}$ given by the minimum norm solution given by equation (21) with a regularization parameter $\alpha$=0.001 for the four geometries depicted in Figures 8-11 above.

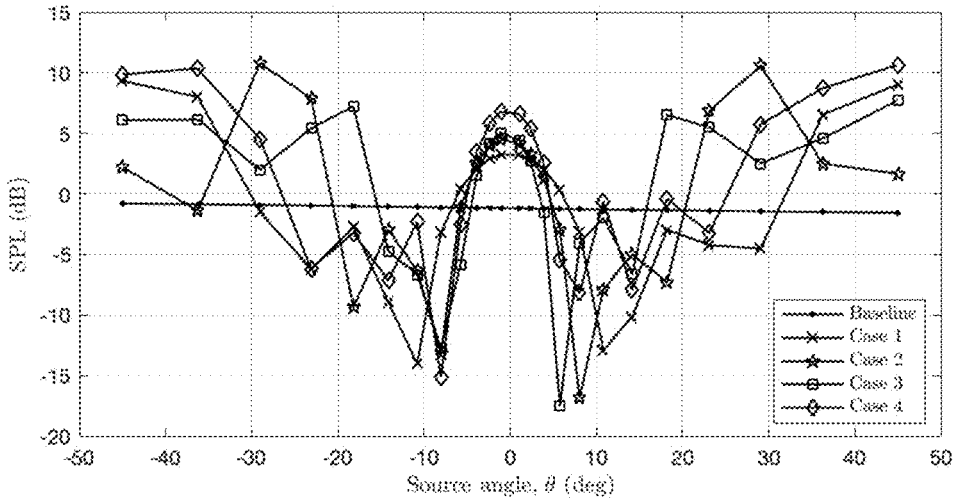

Figure 14. The magnitudes of the components of the optimal vector of source strengths $\mathbf{v}_{opt}$ given by the minimum norm solution given by equation (21) at a frequency of 1KHz for the four geometries depicted in Figures 8-11. A regularization parameter $\alpha$=0.001 was used.

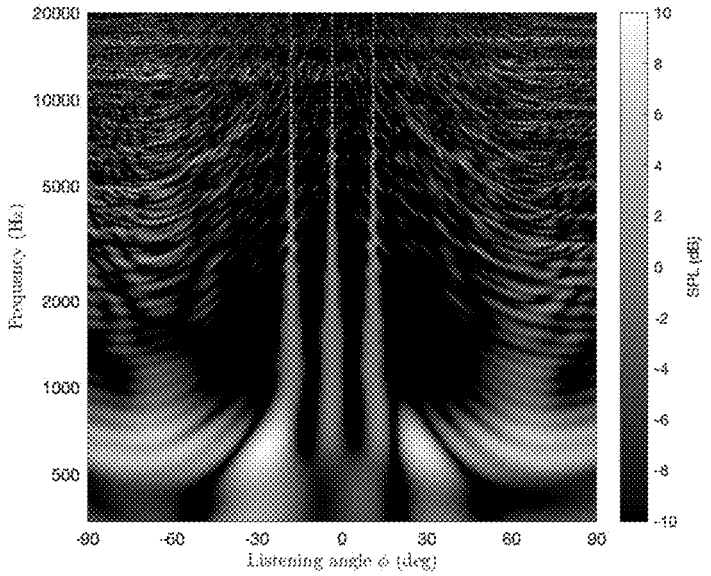
Figure 15. The interference pattern produced by the source strengths derived using the regularized minimum norm solution for the arrangement of Case1.
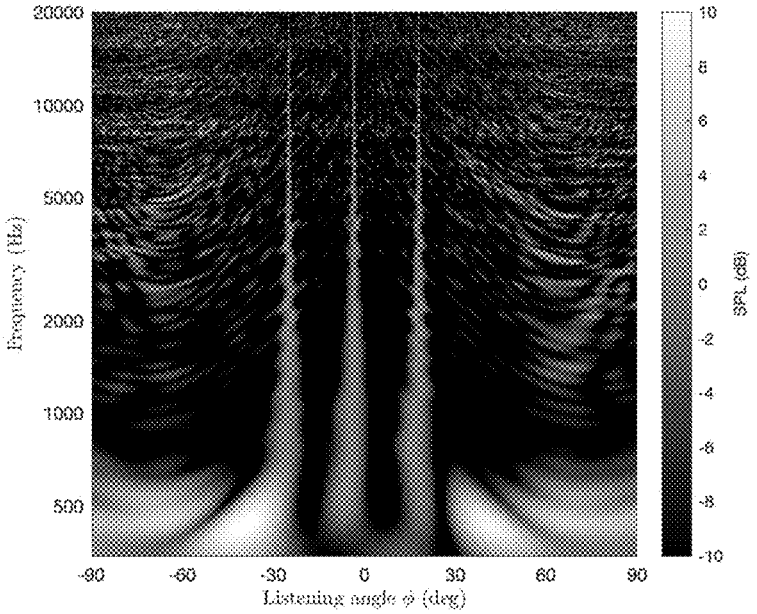
Figure 16. The interference pattern produced by the source strengths derived using the regularized minimum norm solution for the arrangement of Case 2.

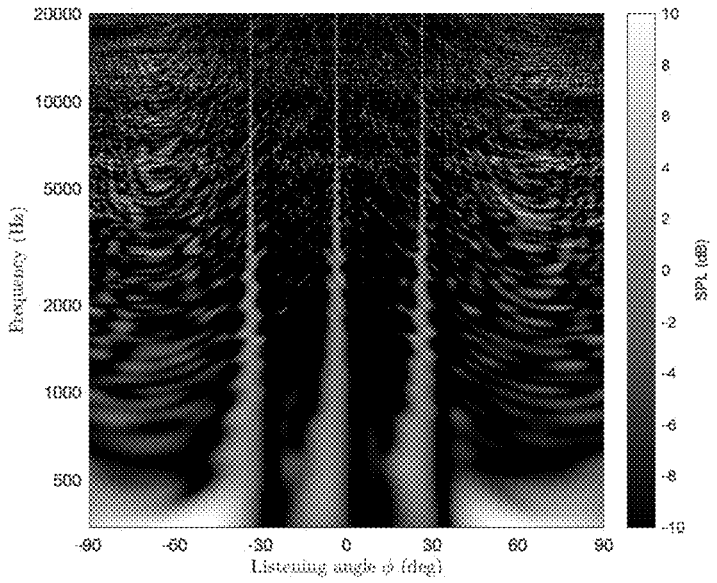
Figure 17. The interference pattern produced by the source strengths derived using the regularized minimum norm solution for the arrangement of Case 3.
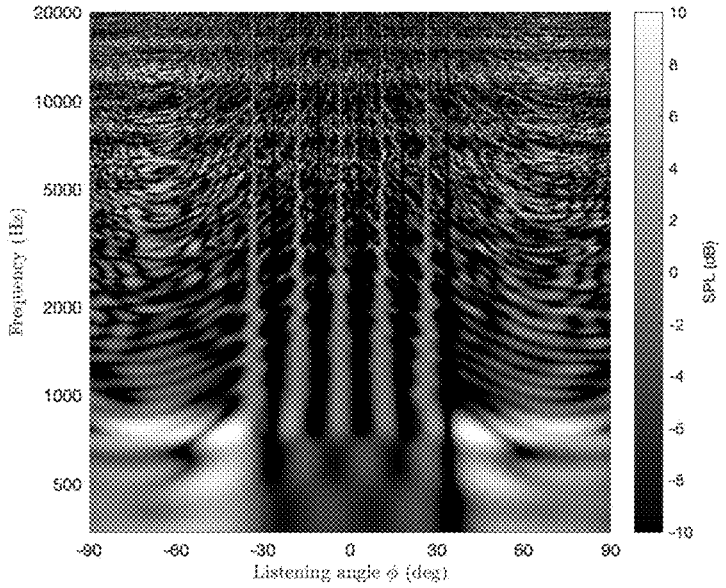
Figure 18. The interference pattern produced by the source strengths derived using the regularized minimum norm solution for the arrangement of Case 4.

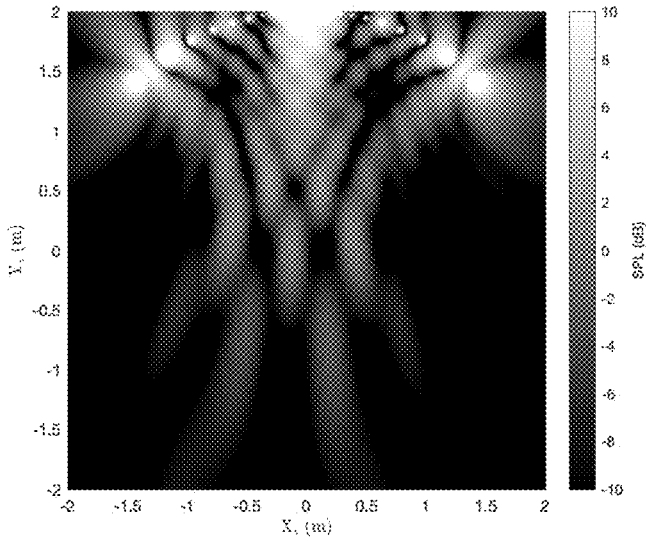
Figure 19. The sound field at 1kHz produced by source strengths derived using the regularized minimum norm solution for the arrangement of Case 1.
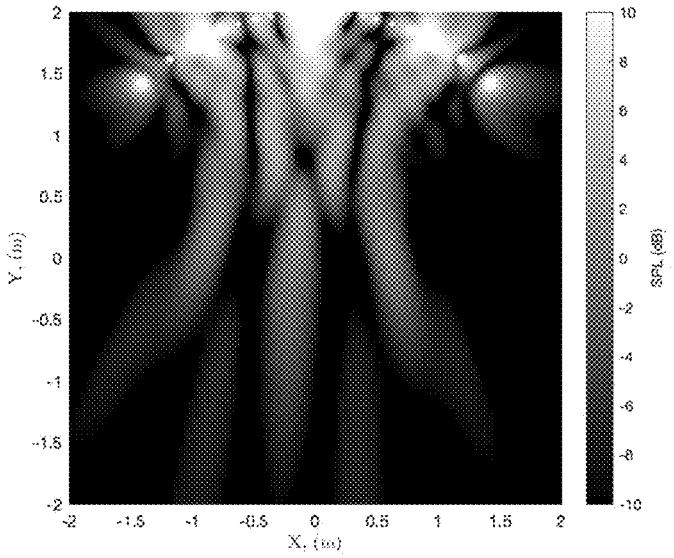
Figure 20. The sound field at 1kHz produced by source strengths derived using the regularized minimum norm solution for the arrangement of Case 2.

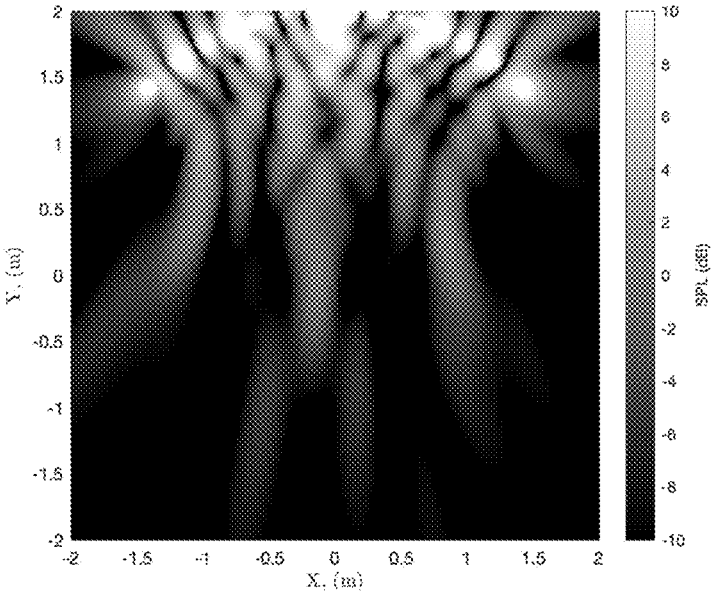
Figure 21. The sound field at 1kHz produced by source strengths derived using the regularized minimum norm solution for the arrangement of Case 3.
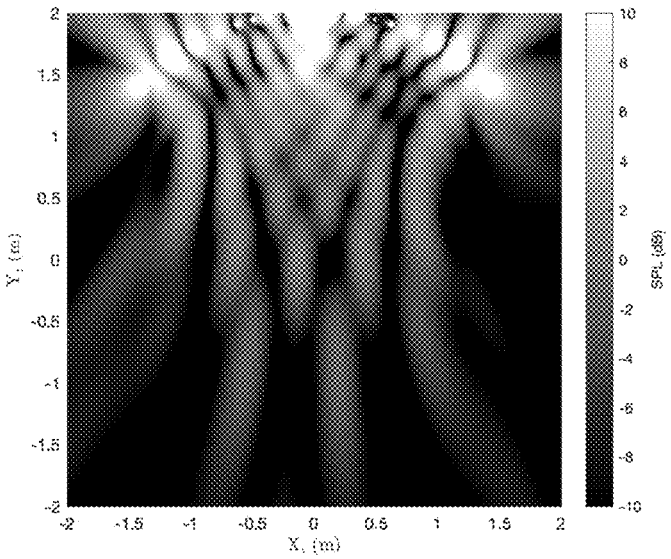
Figure 22. The sound field at 1kHz produced by source strengths derived using the regularized minimum norm solution for the arrangement of Case 4.

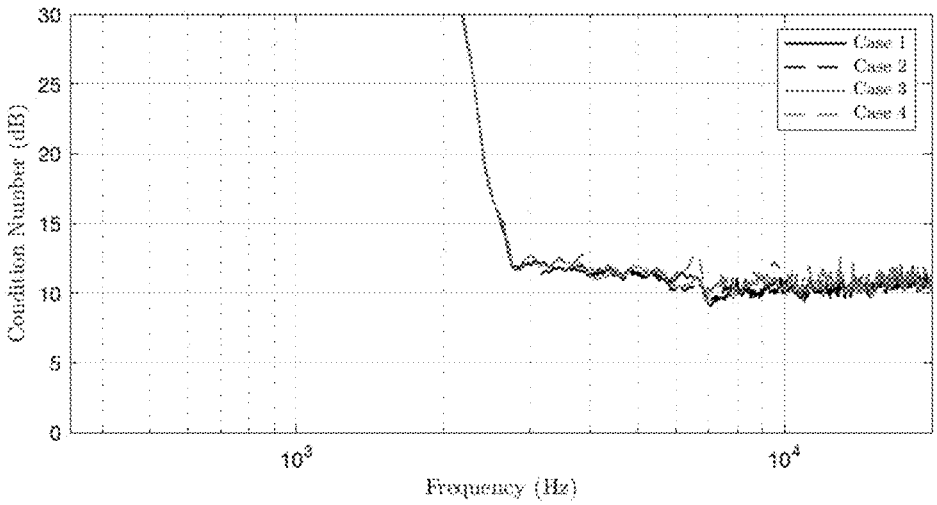
Figure 23. The condition number of the matrix A for the four geometries depicted in Figures 8-11
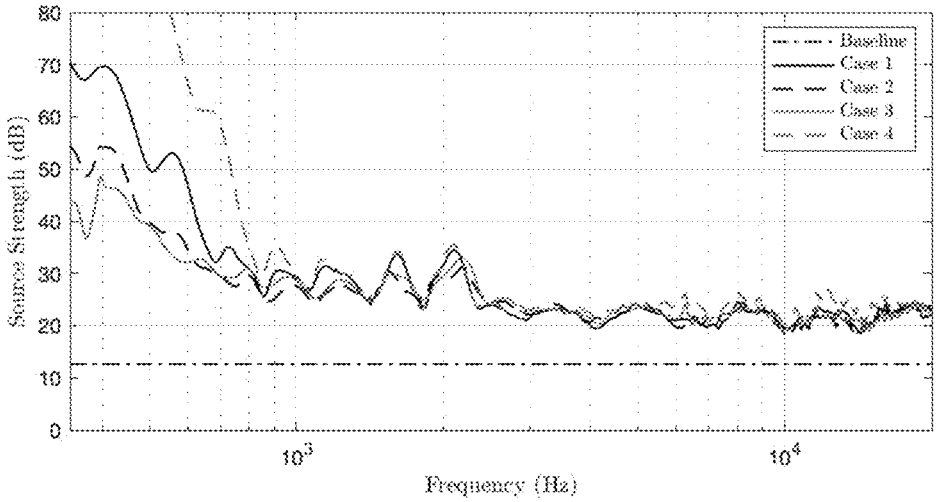
Figure 24. The sum of squared source strengths $\mathbf{v}_{opt}{}^{\mathrm{H}}\mathbf{v}_{opt}$ given by the QR factorization and Lagrange multiplier solutions (equations (27) and (30)) with regularization parameters $\eta, \beta$=0.001 for the four geometries depicted in Figures 8-11 above.

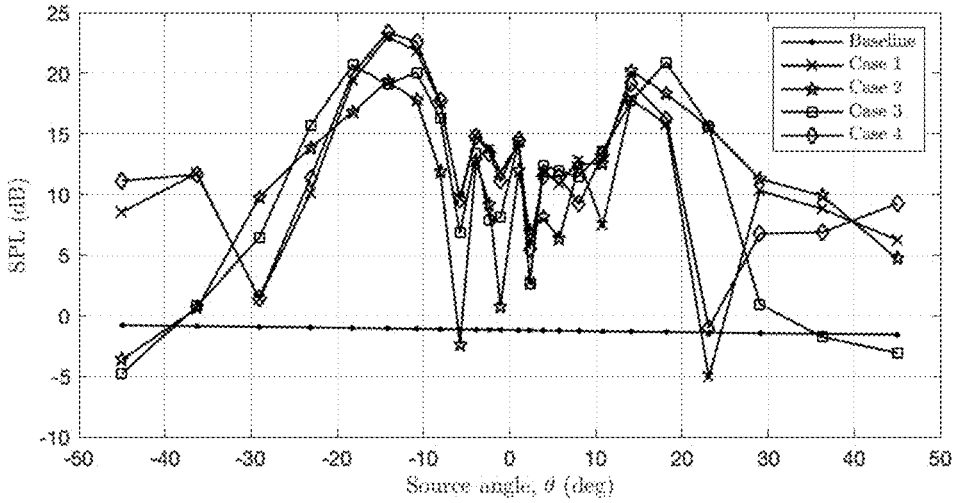

Figure 25. The magnitudes of the components of the optimal vector of source strengths $\mathbf{v}_{opt}$ given by the QR factorization and Lagrange multiplier solutions at a frequency of 1kHz for the four geometries depicted in Figures 8-11. Regularization parameters $\eta, \beta$=0.001 were used.

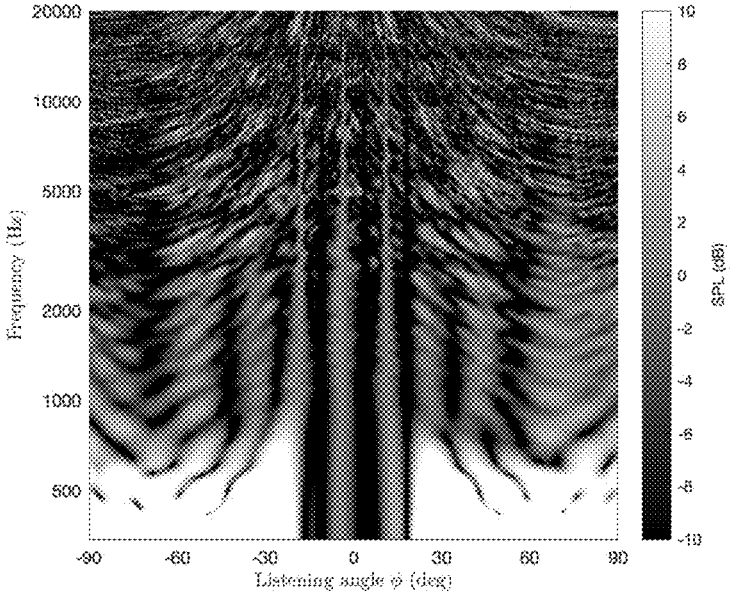

Figure 26. The interference pattern produced by the source strengths derived using the regularized QR factorization and Lagrange multiplier solutions for the arrangement of Case1.

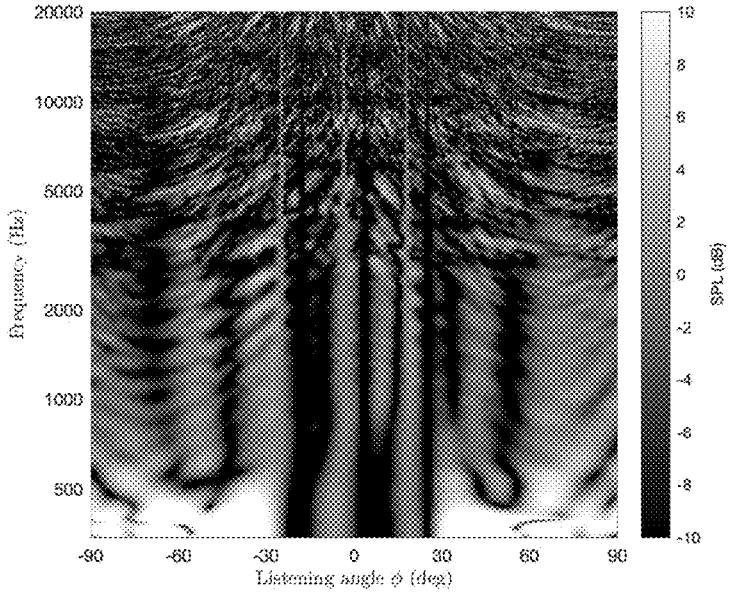

Figure 27. The interference pattern produced by the source strengths derived using the regularized QR factorization and Lagrange multiplier solutions for the arrangement of Case 2.

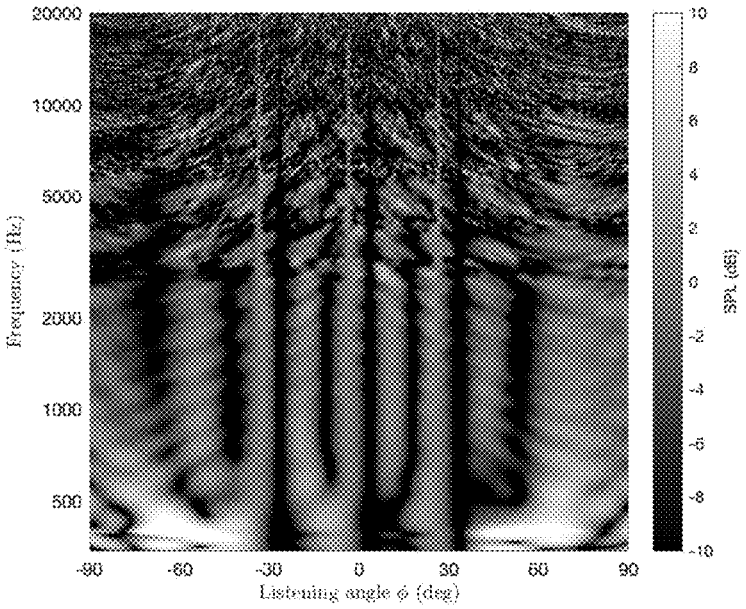

Figure 28. The interference pattern produced by the source strengths derived using the regularized QR factorization and Lagrange multiplier solutions for the arrangement of Case 3.

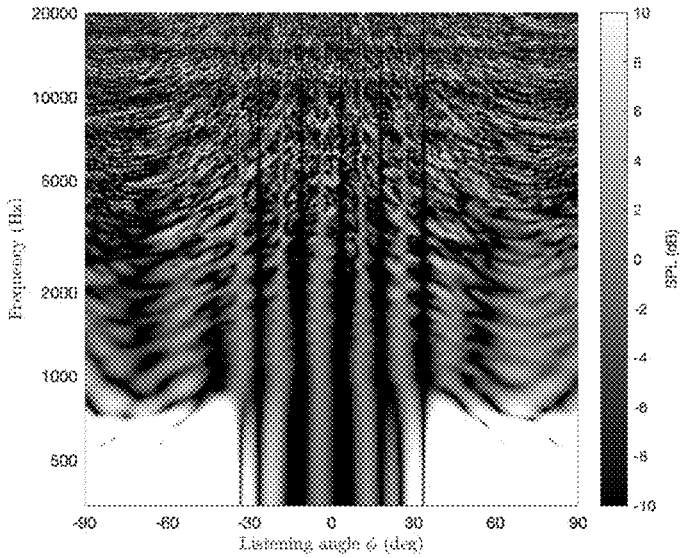
Figure 29. The interference pattern produced by the source strengths derived using the regularized QR factorization and Lagrange multiplier solutions for the arrangement of Case 4.
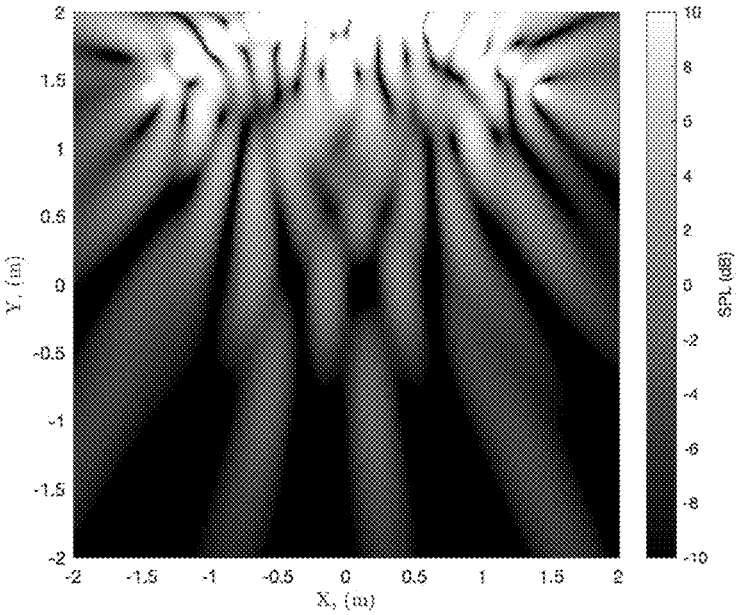
Figure 30. The sound field at 1kHz produced by source strengths derived using the regularized QR factorization and Lagrange multiplier solutions for the arrangement of Case 1.

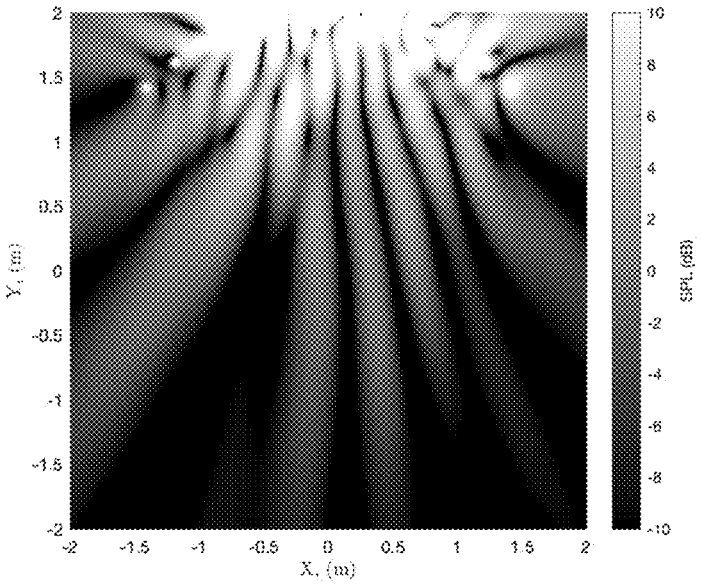
Figure 31. The sound field at 1kHz produced by source strengths derived using the regularized QR factorization and Lagrange multiplier solutions for the arrangement of Case 2.
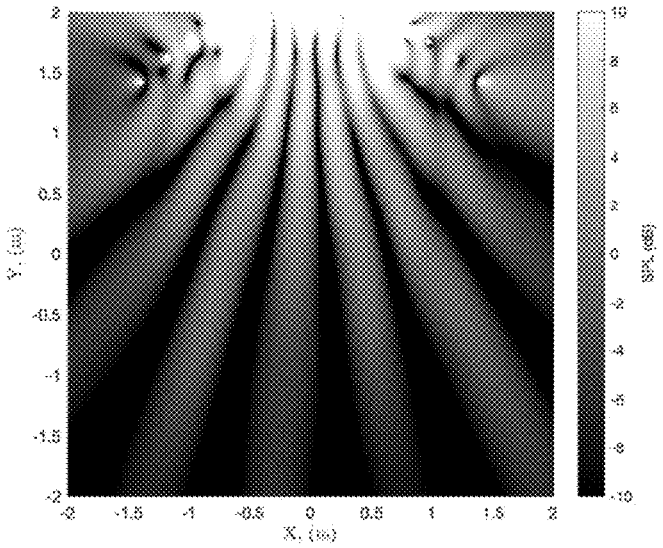
Figure 32. The sound field at 1kHz produced by source strengths derived using the regularized QR factorization and Lagrange multiplier solutions for the arrangement of Case 3.

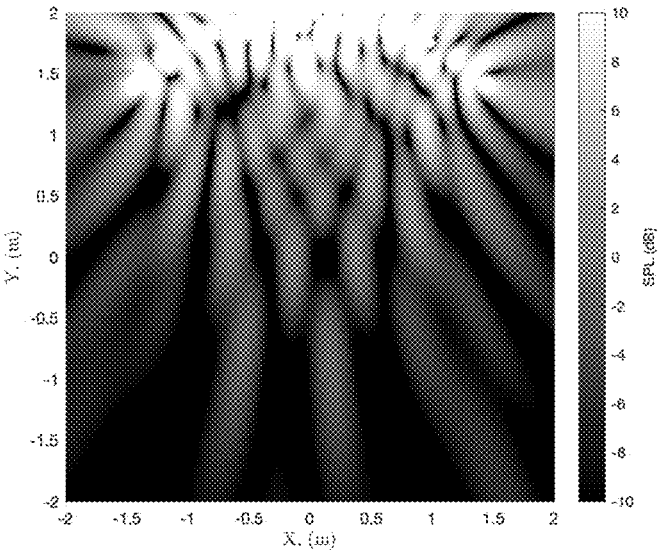
Figure 33. The sound field at 1kHz produced by source strengths derived using the regularized QR factorization and Lagrange multiplier solutions for the arrangement of Case 4.
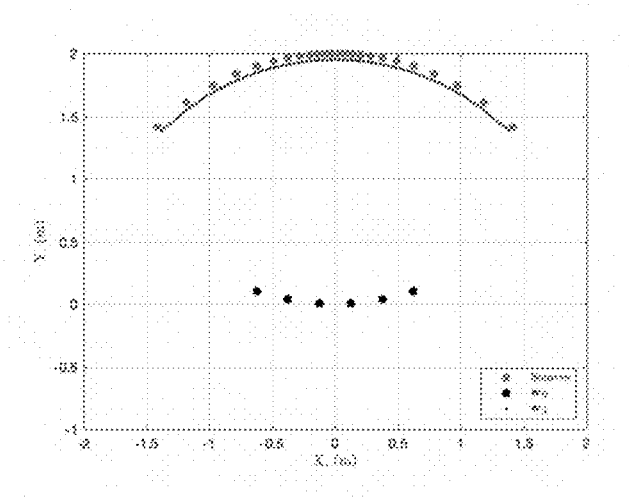
Figure 34. An array of sensors placed at a radial distance of 1.95m from the origin (i.e. at a distance of 0.05m from the source array). The number of sensors used is 95

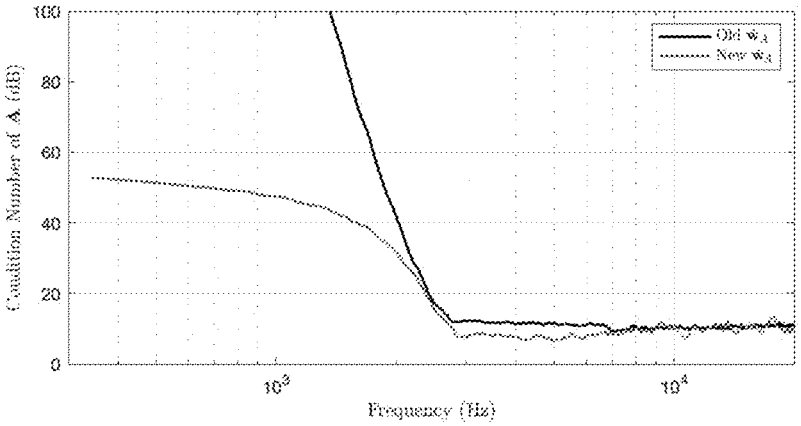

Figure 35. The condition number of the matrix A for the sensor array placed close to the source arc in addition to the sensor array on the listener arc (light grey line) compared to the condition number of the matrix A when the sensors are placed on the listener arc (black line)

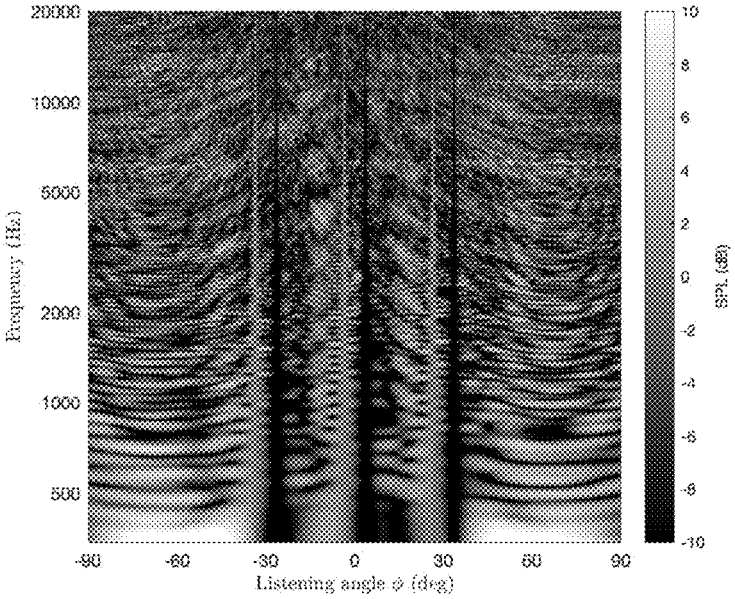

Figure 36. The interference pattern produced in Case 3 when the regularized QR factorization and Lagrange multiplier methods are used to compute the source strengths with the sensor array placed as illustrated in Figure 34.

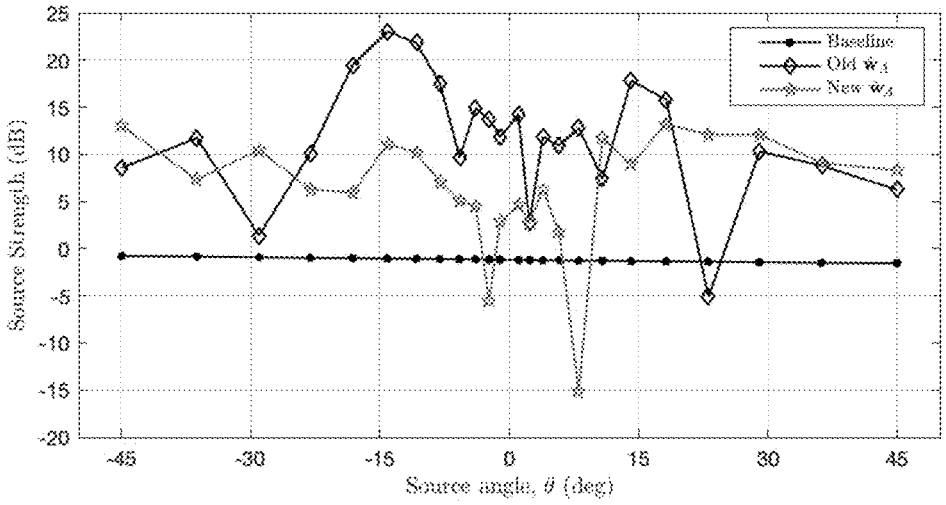

Figure 37. The source strength magnitudes (light grey line) produced in Case 3 when the regularized QR factorization and Lagrange multiplier methods are used to compute the source strengths with the sensor array placed as illustrated in Figure 34.

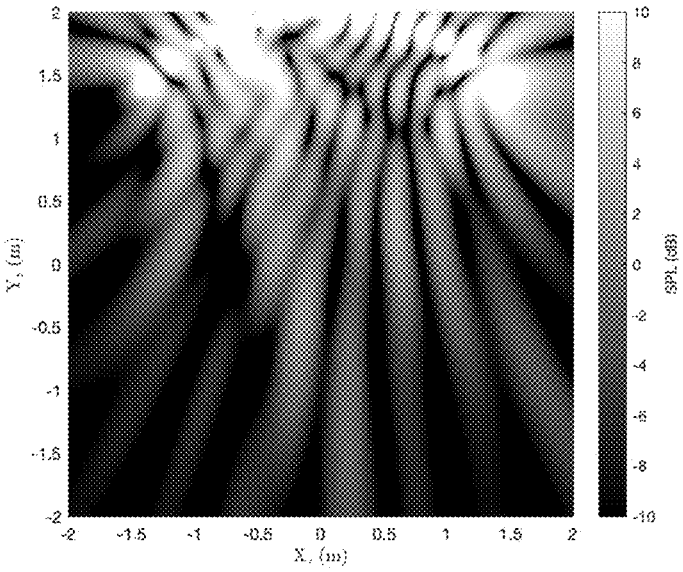

Figure 38. The sound field at 1kHz produced in Case 3 when the regularized QR factorization and Lagrange multiplier methods are used to compute the source strengths with the sensor array placed as illustrated in Figure 34.

SOUND REPRODUCTION

TECHNICAL FIELD

The present invention relates generally to sound reproduction systems, and may be viewed as relating to virtual sound systems.

BACKGROUND

Takeuchi and Nelson [1] first proposed the Optimal Source Distribution (OSD) for achieving binaural sound reproduction for a single listener. The approach has proven to yield excellent subjective results [2] and has since been implemented in a number of products for virtual sound imaging. A remarkable property of the OSD is that the cross-talk cancellation produced at a single centrally placed listener is replicated at all frequencies at a number of other locations in the radiated sound field, a phenomenon that has since been further investigated [3, 4]. An analysis of this has recently been presented by Yairi et al [5] who also show that once a discrete approximation to the hypothetically continuous OSD is introduced, the effectiveness of the cross-talk cancellation is achieved at many but not all frequencies at the non-central positions in the radiated sound field. The work presented here provides a framework for the analysis of the multiple listener virtual sound imaging problem based on two methods; a minimum norm solution and a linearly constrained least squares approach. The aim is to enable the exploitation of the fundamental property of the OSD with the objective of producing exact cross-talk cancellation for multiple listener positions at all frequencies. The background to the problem is introduced, and then the new theoretical approach is presented. Although the example given below is explained in terms of the original two-channel OSD system, it should also be emphasised that the approach presented is equally applicable to the three-channel extension [6].

We have devised a sound reproduction system in which an approximation of the sound field generated by OSD is reproduced which allows for multiple listeners to simultaneously enjoy the enhanced binaural sound reproduction associated with OSD.

SUMMARY

According to one aspect of the invention there is provided signal processor as claimed in claim 1.

The signal processor may be configured to implement an approximation of the sound field of a two channel OSD system or an approximation of the sound field of a three channel OSD system.

The loudspeaker input signals generated by the signal processor may be representative of a discrete source strength. The loudspeaker input signals may comprise a source strength vector.

The processing which the signal processor is configured to perform may be based on or derived from any of the solutions for producing a source strength signal as set out in the detailed description.

The signal processor may comprise a filter which is arranged to perform at least some of the signal processing.

The processing performed by the signal processor may be in the digital domain.

Optimal Source Distribution, OSD, may be considered as comprising a hypothetically continuous acoustic source distribution, each element of which radiates sound at a specific frequency in order to achieve cross-talk cancellation at the ears of a listener. OSD may also be defined as a symmetric distribution of pairs of point monopole sources whose separation varies continuously as a function of frequency in order to ensure that all frequencies of one-quarter of an acoustic wavelength between source pairs and the ears of the listener. A discretised embodiment of OSD may be described as comprising an array of frequency-distributed loudspeakers in which multiple pairs of loudspeakers are provided, each pair producing substantially the same frequency or substantially the same band of frequencies, wherein those pairs of loudspeakers which produce higher frequencies are placed closer together and those producing lower frequencies are placed further apart. The background to and further details of OSD are contained in the Detailed Description below.

According to another aspect of the invention there is provided a sound reproduction apparatus which comprises the signal processor of the first aspect of the invention, and an array of discretised speakers.

In the case that the invention is implemented by a two-channel system, the array of loudspeakers is divided into two banks or sub-array of the loudspeakers, each sub-array constituting a channel. In a three-channel system, as an enhancement to a two-channel system, a third loudspeaker is included which emits over all frequencies (which are emitted by the two-channel system) and which is located substantially central or intermediate of the two sub-arrays from substantially one and the same position (i.e. there is substantially no frequency emission distribution in space). Different speakers may be arranged to output different respective frequencies or different frequency bands. The speakers may be arranged to emit different respective frequencies in a distributed frequency manner.

The speakers may be arranged in a spatially distributed manner. The spacing between successive/neighbouring speakers may be substantially in accordance with a logarithmic scale.

A speaker may comprise an electro-acoustic transducer.

Each of the loudspeakers of the array may be considered as a discrete source.

According to a further aspect of the invention there is provided machine-readable instructions to implement the processing of the signal processor claim 1.

The instructions may be stored on a data carrier or may be realised as a software or firmware product.

The invention may comprise one or more features, either individually or in combination, as disclosed in the description and/or drawings.

BRIEF DESCRIPTION OF THE DRAWINGS

Various embodiments of the invention will now be described, by way of example only, in which:

FIG. 1 shows the geometry of the two source-single listener arrangement, in which the two sources are spaced apart by a horizontal distance d, FIG. 2 shows an equivalent block diagram describing the source-listener arrangement in FIG. 1, FIG. 3 shows directivity of the Optimal Source Distribution, showing the far field radiation pattern on a decibel scale as a function of the angle $\varphi$, FIG. 4 shows the interference pattern produced by the 2-Channel OSD as a function of the angle $\varphi$ (horizontal axis) and frequency (vertical axis), FIG. 5 shows the arrangement of M point sources (grey symbols) and L points in the sound field at which the complex sound pressure is sampled. Cross-talk cancellation is desired at P points (black symbols) whilst a least squares fit to the OSD sound field is desired at L−P=N points (white symbols).

FIG. 6 shows the angles θ defining the positions of the sources and the optimal frequency at which the path-length difference from each source to the listener's ears is λ/4

FIG. 7 shows the interference pattern produced by the multiple pairs of sources at the positions defined in FIG. 6 as a function of the angle φ and frequency, FIG. 8 shows positions of three listeners in the sound field well-aligned to the OSD interference pattern "Case 1", FIG. 9 shows Positions of three listeners in the sound field not well-aligned to the OSD interference pattern ("Case 2"), FIG. 10 shows positions of three listeners in the sound field well-aligned to the OSD interference pattern ("Case 3"), FIG. 11 shows positions of five listeners in the sound field well-aligned to the OSD interference pattern ("Case 4"), FIG. 12 shows the condition number of the matrix B for the four geometries depicted in FIGS. 8-11 above, FIG. 13 shows the sum of squared source strengths $v_{opt}^{H}v_{opt}$ given by the minimum norm solution given by equation (21) with a regularization parameter α=0.001 for the four geometries depicted in FIGS. 8-11 above, FIG. 14 shows the magnitudes of the components of the optimal vector of source strengths $v_{opt}$ given by the minimum norm solution given by equation (21) at a frequency of 1 KHz for the four geometries depicted in FIGS. 8-11. A regularization parameter α=0.001 was used, FIG. 15 shows the interference pattern produced by the source strengths derived using the regularized minimum norm solution for the arrangement of Case 1, FIG. 16 shows the interference pattern produced by the source strengths derived using the regularized minimum norm solution for the arrangement of Case 2, FIG. 17 shows the interference pattern produced by the source strengths derived using the regularized minimum norm solution for the arrangement of Case 3, FIG. 18 shows the interference pattern produced by the source strengths derived using the regularized minimum norm solution for the arrangement of Case 4, FIG. 19 shows the sound field at 1 kHz produced by source strengths derived using the regularized minimum norm solution for the arrangement of Case 1, FIG. 20 shows the sound field at 1 kHz produced by source strengths derived using the regularized minimum norm solution for the arrangement of Case 2, FIG. 21 shows the sound field at 1 kHz produced by source strengths derived using the regularized minimum norm solution for the arrangement of Case 3, FIG. 22 shows the sound field at 1 kHz produced by source strengths derived using the regularized minimum norm solution for the arrangement of Case 4, FIG. 23 shows the condition number of the matrix A for the four geometries depicted in FIGS. 8-11, FIG. 24 shows the sum of squared source strengths $v_{opt}^{H}v_{opt}$ given by the QR factorization and Lagrange multiplier solutions (equations (27) and (30)) with regularization parameters η,β=0.001 for the four geometries depicted in FIGS. 8-11 above, FIG. 25 shows the magnitudes of the components of the optimal vector of source strengths $v_{opt}$ given by the QR factorization and Lagrange multiplier solutions at a frequency of 1 kHz for the four geometries depicted in FIGS. 8-11. Regularization parameters η,β=0.001 were used, FIG. 26 shows the interference pattern produced by the source strengths derived using the regularized QR factorization and Lagrange multiplier solutions for the arrangement of Case 1, FIG. 27 shows the interference pattern produced by the source strengths derived using the regularized QR factorization and Lagrange multiplier solutions for the arrangement of Case 2, FIG. 28 shows the interference pattern produced by the source strengths derived using the regularized QR factorization and Lagrange multiplier solutions for the arrangement of Case 3, FIG. 29 shows the interference pattern produced by the source strengths derived using the regularized QR factorization and Lagrange multiplier solutions for the arrangement of Case 4, FIG. 30 shows the sound field at 1 kHz produced by source strengths derived using the regularized QR factorization and Lagrange multiplier solutions for the arrangement of Case 1, FIG. 31 shows the sound field at 1 kHz produced by source strengths derived using the regularized QR factorization and Lagrange multiplier solutions for the arrangement of Case 2, FIG. 32 shows the sound field at 1 kHz produced by source strengths derived using the regularized QR factorization and Lagrange multiplier solutions for the arrangement of Case 3, and FIG. 33 shows the sound field at 1 kHz produced by source strengths derived using the regularized QR factorization and Lagrange multiplier solutions for the arrangement of Case 4.

FIG. 34 shows an array of sensors placed at a radial distance of 1.95 m from the origin (i.e. at a distance of 0.05 m from the source array). The number of sensors used is 95.

FIG. 35 shows the condition number of the matrix A for the sensor array placed close to the source arc in addition to the sensor array on the listener arc (light grey line) compared to the condition number of the matrix A when the sensors are placed on the listener arc (black line)

FIG. 36 shows the interference pattern produced in Case 3 when the regularized QR factorization and Lagrange multiplier methods are used to compute the source strengths with the sensor array placed as illustrated in FIG. 34.

FIG. 37 shows the source strength magnitudes (light grey line) produced in Case 3 when the regularized QR factorization and Lagrange multiplier methods are used to compute the source strengths with the sensor array placed as illustrated in FIG. 34.

FIG. 38 shows the sound field at 1 kHz produced in Case 3 when the regularized QR factorization and Lagrange multiplier methods are used to compute the source strengths with the sensor array placed as illustrated in FIG. 34.

DETAILED DESCRIPTION

There are now described a number of solutions to achieve the generation of an approximation of OSD sound field using an array of discrete number of loudspeakers and advantageously obtaining multiple listener positions for binaural sound reproduction. These may be considered as being grouped into two main types, namely a least squares method and minimal norm method. The solutions yielded by such methods are implemented by a signal processor, which may comprise a suitably configured filter set. In the description which follows some further background information regarding OSD is provided to aid understanding of the invention. As will be evident to the person skilled in the art, the solutions presented by both of the different method types can be implemented as suitable signal processing stages and/or steps which generates the respective input signals for each of the loudspeakers of the array.

Optimal Source Distribution

FIG. 1 shows the geometry of the two-loudspeaker/single listener problem and FIG. 2 shows the equivalent block diagram, both figures replicating the notation used by Takeuchi and Nelson [1] and Yairi et al [5]. The following respectively define the desired signals for reproduction, the source signals and the reproduced signals $$d^T=[d_R d_L]\quad v^T=[v_R v_L]\quad w^T=[w_R w_L] \tag{1a,b,c}$$

and the inverse filter matrix and transmission path matrix are respectively defined by $$H=\begin{bmatrix} H_{11} & H_{12} \\ H_{21} & H_{22} \end{bmatrix}\quad C=\begin{bmatrix} C_{11} & C_{12} \\ C_{21} & C_{22} \end{bmatrix} \tag{2a, b}$$

where all variables are in the frequency domain and a harmonic time dependence of $e^{j\omega t}$ is assumed. Thus, v=Hd, =Cv, and w=CHd. Assuming the sources are point monopoles radiating into a free field, with volume accelerations respectively given by $v_R$ and $v_L$, the transmission path matrix takes the form $$C=\frac{\rho_0}{4\pi}\begin{bmatrix} \frac{e^{-jkl_1}}{l_1} & \frac{e^{-jkl_2}}{l_2} \\ \frac{e^{-jkl_2}}{l_2} & \frac{e^{-jkl_1}}{l_1} \end{bmatrix} \tag{3}$$

where the distances between the assumed point sources and the ears of the listener are as shown in FIG. 1, $k=\omega/c_0$ and $\rho_0$, $c_0$ are respectively the density and sound speed. This matrix can be written as $$C=\frac{\rho_0 e^{-jkl_1}}{4\pi l_1}\begin{bmatrix} 1 & ge^{-jk\Delta l} \\ ge^{-jk\Delta l} & 1 \end{bmatrix} \tag{4}$$

where $g=l_1/l_2$ and $\Delta l=l_2-l_1$. If it is assumed that the target values of the reproduced signals at the listeners ears are given by $$d^T=\frac{\rho_0 e^{-jkl_1}}{4\pi l_1}[\,d_R\quad d_L\,] \tag{5}$$

it follows that [1] the inverse filter matrix is given by simple inversion of the elements of the matrix C yielding $$H=\frac{1}{1-g^2e^{-2jk\Delta r\sin\theta}}\begin{bmatrix} 1 & -ge^{-jk\Delta r\sin\theta} \\ -ge^{-jk\Delta r\sin\theta} & 1 \end{bmatrix} \tag{6}$$

where the approximation $\Delta l\leq\Delta r\sin\theta$ has been used, assuming that $l\gg\Delta r$. Takeuchi and Nelson [1] present the singular value decomposition of the matrix C (and thus the matrix H) and demonstrate that the two singular values are equal when $$k\Delta r\sin\theta=n\pi/2 \tag{7}$$

where n is an odd integer (1, 3, 5 . . . ). Under these circumstances, the inversion problem is intrinsically well-conditioned and reproduction is accomplished with minimal error. Note that this condition is equivalent to the difference in path lengths $\Delta l$ being equal to odd integer multiples of one quarter of an acoustic wavelength $\lambda$. Since the angle $2\theta$ is equal to the angular span of the sources (see FIG. 1), this condition also implies that the source span should vary continuously with frequency to preserve the $\lambda/4$ path length difference. The OSD is a therefore continuous distribution of pairs of sources, each radiating a different frequency, with those radiating high frequencies placed close together, and those radiating lower frequencies placed further apart. This may be termed a distributed frequency arrangement. A further property of the OSD is that, provided the sources are distributed to preserve the path length difference condition $\Delta l=n\lambda/4$ where n is an odd integer, then the inverse filter matrix reduces to $$H=\frac{1}{1+g^2}\begin{bmatrix} 1 & -jg \\ -jg & 1 \end{bmatrix} \tag{8}$$

This gives a particularly simple form of filter matrix, and through the term −jg, involves simple inversion, 90-degree phase shift, and a small amplitude adjustment of the input signals.

As shown by Yairi et al [5] this idealised source distribution has some attractive radiation properties. This is best demonstrated by computing the far field pressure $p(r,\varphi)$ radiated by a pair of sources with inputs determined by the above optimal inverse filter matrix. Furthermore, if one assumes that the desired signals for reproduction are given by $d^T=[1\ 0]$, then it follows that the source signals are given by $$v=Hd=\frac{1}{1+g^2}\begin{bmatrix} 1 & -jg \\ -jg & 1 \end{bmatrix}\begin{bmatrix} 1 \\ 0 \end{bmatrix}=\frac{1}{1+g^2}\begin{bmatrix} 1 \\ -jg \end{bmatrix} \tag{9}$$

Therefore the pressure field is given by the sum of the two source contributions such that $$p(r,\varphi)=\frac{\rho_0}{4\pi(1+g^2)}\left[\frac{e^{-jkr_1}}{r_1}-jg\frac{e^{-jkr_2}}{r_2}\right] \tag{10}$$

which, writing $h=r_1/r_2$, can be written as $$p(r,\varphi)=\frac{\rho_0 e^{-jkr_1}}{4\pi r_1(1+g^2)}[1-jghe^{-jk(r_2-r_1)}] \tag{11}$$

Now note that in the far field, where $r_1,r_2\gg d$, the distance between the sources, then it follows from the geometry of FIG. 1, that $$r_1\approx r-\left(\frac{d}{2}\right)\sin\varphi,\quad r_2\approx r+\left(\frac{d}{2}\right)\sin\varphi \tag{12a, b}$$

and therefore that $$p(r,\varphi)=\frac{\rho_0 e^{-jkr_1}}{4\pi r_1(1+g^2)}[1-jghe^{-jkd\sin\varphi}] \tag{13}$$

The squared modulus of the term in square brackets is given by $$|1-jghe^{-jkd\sin\varphi}|^2=1+(gh)^2-2gh\sin(kd\sin\varphi) \tag{14}$$

and therefore the modulus squared of the pressure field can be written as $$|p(r,\varphi)|^2=\left(\frac{\rho_0}{4\pi r_1}\right)^2\left(\frac{1+(gh)^2-2gh\sin(kd\sin\varphi)}{1+g^2}\right) \tag{15}$$

Now note that as r increases, such that we can make the approximation $r\approx r_1\approx r_2$, one can also make the approximations $g\approx h\approx 1$ and this expression becomes $$|p(r,\varphi)|^2=\left(\frac{\rho_0}{4\pi r}\right)^2(1-\sin(kd\sin\varphi)) \tag{16}$$

and therefore maxima and minima are produced in the sound field when $kd\sin\varphi=n\pi/2$ where n is odd. The term $(1-\sin(kd\sin\varphi))$ becomes zero at n=1, 5, 9 . . . etc. and is equal to two when n=3, 7, 11 . . . etc. The form of the squared modulus of the sound pressure as a function of the angle φ is illustrated in FIG. 3.

It is to be noted that this directivity pattern of the far field pressure is the same at all frequencies. This is because the value of $k\Delta r\sin\theta=n\pi/2$ where n is an odd integer, and since from the geometry of FIG. 1, $\sin\theta=d/2l$, then $kd=n\pi l/2\Delta r$. Thus kd and therefore $\omega d/c_0$ takes a constant value (assuming n=1), and is thus determined entirely by the geometrical arrangement of the two on-axis points chosen initially for cross-talk cancellation. The directivity pattern illustrated in FIG. 3 demonstrates that an intrinsic property of the OSD is the production of cross-talk cancellation at multiple angular positions in the sound field. FIG. 4 shows the sound field along a circular listener arc as a function of frequency, illustrating that the interference pattern is maintained as a function of frequency, except for frequencies below a minimum value. These plots assume a value of Δr=0.25 m. However, in any real application, an approximation to the OSD must be realised by a discrete number of loudspeakers. The details disclosed in the following sections enable the determination of the signals input to a discrete number of sources in order to achieves the objective of producing cross-talk cancellation at multiple listener positions.

Multiple Discrete Sources and Reproduction at Multiple Points

Reference is made to the case illustrated in FIG. 5. The strength of a distributed array of acoustic sources is defined by a vector v of order M and the pressure is defined at a number of points in the sound field by the vector w of order. The curved geometry chosen here replicates that analysed by Yairi et al [7] who demonstrate a number of analytical advantages in working with such a source and sensor arrangement. In general w=Cv where C is an L×M matrix. However, it is helpful to partition this matrix C into two other matrices A and B and also partition the vector w of reproduced signals so that $$\begin{bmatrix} w_A \\ w_B \end{bmatrix}=Cv=\begin{bmatrix} A \\ B \end{bmatrix}v \tag{17}$$

The vector $w_B$ is of order P and defines the reproduced signals at a number of pairs of points in the sound field at which cross-talk cancellation is sought. Thus $w_B=Bv$ where B defines the P×M transmission path matrix relating the strength of the M sources to these reproduced signals. The vector $w_A$ is of order N and defines the reproduced signals sampled at the remaining points in the sound field. Thus N=L−P and the reproduced field at these remaining points can be written as $w_A=Av$, where A is the N×M transmission path matrix between the sources and these points.

Now note that the desired pressure at the P points in the sound field at which cross-talk cancellation is required can be written as the vector $\hat{w}_B$. This vector can in turn be written as $\hat{w}_B=Dd$, where the matrix D defines the reproduced signals required in terms of the desired signals. As a simple example, suppose that cross-talk cancellation is desired at two pairs of points in the sound field such that $$\begin{bmatrix} \hat{w}_{B1} \\ \hat{w}_{B2} \\ \hat{w}_{B3} \\ \hat{w}_{B4} \end{bmatrix}=\begin{bmatrix} 1 & 0 \\ 0 & 1 \\ 1 & 0 \\ 0 & 1 \end{bmatrix}\begin{bmatrix} d_R \\ d_L \end{bmatrix} \tag{18}$$

The matrix D has elements of either zero or unity, is of order P×2, and may be extended by adding further pairs of rows if cross talk cancellation is required at further pairs of points. Similar to the analysis presented above, we assume that the inputs to the sources are determined by operating on the two desired signals defined by the vector d via an M×2 matrix H of inverse filters. The task is to find the source strength vector v that generates cross-talk cancellation at multiple pairs of positons in the sound field, guided by the observation of the directivity pattern illustrated in FIG. 3.

Minimum Norm Solution

Assume that cross-talk cancellation is required at the specific sub-set of all the points in the sound field where the number P of points in the sound field is smaller than the number of sources M available to reproduce the field. One can then seek to ensure that we make $w_B=\hat{w}_B=Dd$ whilst minimising the "effort" $\|v\|_2^2$ made by the acoustic sources. The problem is thus $$\min\|v\|_2^2 \text{ subject to } \hat{w}_B=Dd \tag{19}$$

where $\|\ \|_2$ denotes the 2-norm. The solution [8, 9] to this minimum norm problem is given by the optimal vector of source strengths defined by $$v_{opt}=B^H[BB^H]^{-1}Dd \tag{20}$$

where the superscript H denotes the Hermitian transpose. Thus a possible solution to the problem can be found that requires only specification of the points at which cross-talk cancellation is required in the sound field. A sensible approach might be to use the directivity of the OSD as a guide to the choice of angular location these points. Note that it is also possible to include a regularization factor α into this solution such that $$v_{opt}=B^H[BB^H+\alpha I]^{-1}Dd \tag{21}$$

where I is the identity matrix.

Linearly Constrained Squares Solution

Extension of the Unconstrained Solution

A further approach to the exploitation of the known properties of the optimal source distribution is to attempt not only to achieve cross-talk cancellation at multiple pairs of points as in the case above, but also to attempt a "best fit" of the radiated sound field to the known directivity function of the OSD. In this case, the problem is a least squares minimisation with an equality constraint. Thus, as above, a sub-set of desired signals at pairs of points in the sound field is defined by $\hat{w}_B$=Dd. The aim is also to minimise the sum of squared errors between the desired sound field and the reproduced field at the remaining L−P=N points of interest (see FIG. 5).

Here it is assumed that the number N of these points is greater than the number of sources M. The desired sound field at these points can be chosen to emulate the directivity of the OSD at angular positions between those at which cross-talk cancellation is sought. One therefore seeks the solution of $$\min\|Av-\hat{w}_A\|_2^2 \text{ subject to } \hat{w}_B=Bv \tag{22}$$

Before moving to exact solutions, it is worth noting that Golub and Van Loan [9] point out that an approximate solution to the linearly constrained least squares problem is to solve the unconstrained least squares problem given by $$\min\left\|\begin{bmatrix} A \\ \gamma B \end{bmatrix} v - \begin{bmatrix} \hat{w}_A \\ \gamma \hat{w}_B \end{bmatrix}\right\|_2^2 \tag{23}$$

They demonstrate that the solution to this problem, which is a standard least squares problem, converges to the constrained solution as $\gamma\rightarrow\infty$. They also point out, however, that numerical problems may arise as $\gamma$ becomes large.

Solution Using QR Factorisation

An exact solution to this problem can deduced by following Golub and Van Loan [9], but working with complex variables and replacing the matrix transpose operation by the complex conjugate transpose. The method relies on the use of the use of the QR-factorisation of the matrix $B^H$ where $$B^H = Q\begin{bmatrix} R \\ 0 \end{bmatrix} \tag{24}$$

where $B^H$ is M×P, Q is an M×M square matrix having the property $Q^HQ=QQ^H=I$ and R is an upper triangular matrix of order P×P and the zero matrix is of order (M−P)×P. Now define $$AQ = [A_1 A_2]\ Q^H v = \begin{bmatrix} y \\ z \end{bmatrix} \tag{25}$$

where the matrix $A_1$ is N×P, the matrix $A_2$ is N×(M−P), and the vectors y and z are of order P and M−P respectively. As shown in Appendix 1, the optimal solution to the least squares problem can be written as $$v_{opt}=Q\begin{bmatrix} y_{opt} \\ z_{opt} \end{bmatrix} \tag{26}$$

and partitioning the matrix Q such that $v_{opt}=Q_1\gamma_{opt}+Q_2z_{opt}$ enables the solution to be written as $$v_{opt}=Q_2A_2^{\dagger *}\hat{w}_A+(Q_1R^{H-1}-Q_2A_2^{\dagger}A_1R^{H-1})\hat{w}_B \tag{27}$$

where $A_2^{\dagger}=[A_2^HA_2]^{-1}A_2^H$ is the pseudo inverse of the matrix $A_2$. This enables the calculation of the optimal source strengths in the discrete approximation to the OSD in terms of the signals $\hat{w}_B$ reproduced at the points of cross talk cancellation, and the remaining signals $\hat{w}_A$ specified by the directivity of the OSD. Note that it is also possible to include a regularization parameter into the computation of the matrix $A_2^{\dagger}$ such that $$A_2^{\dagger}=[A_2^HA_2+\eta I]^{-1}A_2^H \tag{28}$$

where $\eta$ is the regularization parameter.

Solution Using Lagrange Multipliers

Whilst the above solution provides a compact and efficient means for solving the problem at hand, it is shown in Appendix 2 that it is also possible to derive a solution that is expressed explicitly in terms of the matrices A and B. The solution can be derived by using the method of Lagrange multipliers where one seeks to minimise the cost function given by $$J=(Av-\hat{w}_A)^H(Av-\hat{w}_A)+(Bv-\hat{w}_B)^H\mu+\mu^H(Bv-\hat{w}_B)+\beta v^Hv \tag{29}$$

where $\mu$ is a complex vector of Lagrange multipliers and the term $\beta$ is used to penalise the "effort" associated with the sum of squared source strengths. As shown in Appendix 2, the minimum of this function is defined by $$v_{opt}=[I-\tilde{A}B^H[B\tilde{A}B^H]^{-1}B]A^{\dagger}\hat{w}_A+\tilde{A}B^H[B\tilde{A}B^H]^{-1}\hat{w}_B \tag{30}$$

where the matrices $\tilde{A}$ and $A^{\dagger}$ are respectively defined by $$\tilde{A}=[A^HA+\beta I]^{-1} \text{ and } A^{\dagger}=[A^HA+\beta I]^{-1}A^H \tag{31}$$

This solution has also been derived by Olivieri et al [10], although the solution presented by those authors differs from that above by a factor ½ that multiplies the first term in square brackets above.

Various applications of the solution types/methodologies set out above are now described.

Geometry for Illustrative Numerical Simulations

In what follows, the geometry chosen for illustrative numerical simulations is that depicted in FIG. 5, where both sources and receivers are placed on circular arcs. The source arc has a radius of 2 m and is centred on the origin of the coordinate system shown (X=0, Y=0). The listener arc has a radius of 2 m and is centred on (X=2 m, Y=0). The effective "head width" of the listeners on the arc is assumed to be 0.25 m. Whilst these simulations have been undertaken in order to illustrate the performance of the design methods on a specific geometry, it should be emphasized that the methods can be applied to other geometrical arrangements (for example, where the sources are disposed in a linear array).

Solution Using Partition of the Frequency Range

A straightforward solution to achieving a good fit to the OSD sound field is to allocate pairs of sources to given frequency ranges and to apply band-pass filters to the signals to be reproduced prior to transmission via each source pair. In order to achieve this it is helpful to allocate the source pairs in a logarithmic spatial arrangement so that there is a higher concentration of sources at the centre of the source array (that transmit higher frequencies) whilst the concentration of sources is reduced towards the ends of the array (where sources transmit lower frequencies). As an example, FIG. 6 specifies such a distribution of 24 sources (12 pairs) and their angular position on the source arc. FIG. 7 shows the interference pattern produced along the receiver arc as a function of frequency. Band-pass filters may be used to smooth the transition between frequency bands to yet further improve the sound field that is reproduced.

Application of the Minimum Norm Solution

Numerical simulation of the minimum norm solution given by equation (21) above shows that this provides a viable method for determining the source strengths necessary to ensure cross-talk cancellation at multiple positions in the sound field. FIGS. 8, 9, 10 and 11, show four cases of listener positions in the sound field, again using the geometry described above. FIGS. 8 and 10 (Cases 1 and 3) show the positions of the ears of three listeners in the sound field when the positions of the listeners are well aligned to the OSD sound field (i.e. one ear is in a null of the interference pattern, whilst the other ear is at a maximum). FIG. 9 (Case 2) shows three listener positions that are not well aligned to the OSD sound field (i.e. the ear positions are not placed at either maxima or minima in the sound field). Finally, FIG. 11 (Case 4) shows five listener positions that are well-aligned to the OSD sound field.

In all cases it has been found that the minimum norm solution provides satisfactory solutions when a suitable value of the regularization parameter $\alpha$ is chosen. FIG. 12 shows the condition number of the matrix B for Cases 1-4. This clearly shows the rapid increase in condition number as frequency decreases. However, with regularization parameter $\alpha$=0.001, then the sum of squared source strengths $v_{opt}^{H}v_{opt}$ resulting from the application of equation (21) can be contained at low frequencies. This is illustrated in FIG. 13. The magnitudes of the components of the optimal vector of source strengths $v_{opt}$ given by the minimum norm solution are shown in FIG. 14 for all the Cases1-4. These source strength magnitudes are compared to a "baseline" distribution of source strength which is that required to sustain a unit pressure at one ear of the centrally located listener. It is notable that excessive source strengths are not required to generate the minimum norm solution (as one would expect).

FIGS. 15-18 show the interference patterns (as a function of frequency and position on the listener arc) that are produced by the source strengths derived using the regularized minimum norm solution for the arrangements of Cases 1-4 respectively. All these results have been derived through application of equation (21) with regularization parameter $\alpha$=0.001. It is notable that in all cases the desired cross-talk cancellation is produced over the whole frequency range, although the spatial extent of the cancellation reduces as frequency increases. FIGS. 19-22 show the sound field at 1 kHz produced by the source strengths derived using the regularized minimum norm solution for the arrangements of Cases 1-4 respectively. In all cases, cross talk cancellation is produced as desired.

Application of the Linearly Constrained Least Squares Solution

Three potential methods of solution have been presented above. Extensive numerical simulations have revealed that that the extension to the unconstrained solution produces results for the optimal source strength vector that converge to the results produced by the QR factorization method without any regularization. Furthermore, the QR factorization method and the Lagrange multiplier method produce identical results when identical regularization parameters are used (i.e. $\eta$ and $\beta$ respectively are chosen to be the same). Finally, it has been found that as the value of the regularization parameters $\eta$ and $\beta$ are increased, both the QR factorization method and the Lagrange multiplier method approach the minimum norm solution.

First note that the matrix A is badly-conditioned at low frequencies for all four cases as illustrated in FIG. 23. It should be noted that the number of points N used to sample the field along the listener arc are respectively 95, 95, 93 and 89 for Cases 1-4 respectively, although this does not change the broad observation regarding the conditioning of A. However application of appropriately chosen regularization enables useful solutions to be derived, FIG. 24 shows the sum of squared source strengths in each case with regularization parameters $\eta,\beta$=0.001. FIG. 25 shows the magnitudes of the source strengths at 1 kHz, these being notably higher than in the minimum norm case (FIG. 14). However, the results of applying the regularized constrained least squares solution in Cases 1-4 are shown in FIGS. 26-29 which demonstrate that cross-talk cancellation can be effectively achieved over the full frequency range. The sound fields generated at 1 kHz are shown for illustrative purposes in FIGS. 30-33 for Cases 1-4 respectively. Again, the solutions are shown to give good cross-talk cancellation in the sound fields produced, with arguably a greater degree of replication of the target OSD sound field than is produced by the minimum norm solution, Case 3 in particular exhibits a very close degree of replication of the target sound field. The addition of further points on other arcs in the sound field can be used to further improve the degree to which the sound field matches that produced by the OSD.

Application of the Linearly Constrained Solution with Enhanced Conditioning

The conditioning of the matrix A can be improved significantly by placing the field points at which $\hat{w}_A$ is defined closer to the source array as illustrated in FIG. 34. This shows an array of sensors placed at a radial distance of 1.95 m from the origin (i.e. at a distance of 0.05 m from the source array). The number of sensors used is 95. This reduces the condition number of A as shown in FIG. 35. The interference pattern produced in Case 1 is shown in FIG. 36 when the regularized QR factorization and Lagrange multiplier methods is used to compute the source strengths. These show a reduction in the large pressures produced at low frequencies compared to the equivalent source strengths when the sensors are placed on the listener arc at 2 m radial distance from the sources. The source strength magnitudes are shown in FIG. 37. These show reduced values compared to the equivalent source strengths when the sensors are placed on the 2 m listener arc. Finally the sound field at 1 kHz is shown in FIG. 38. Advantageously, the fact that the sensors (or what may be thought of as virtual sampling points in the sound field) are positioned closer means that the condition number of the transmission path matrix A is smaller.

Use of Regularization to Achieve Sparse Solutions

The regularization methods used in the numerical studies described are of particular use to achieve viable solutions, especially in the constrained least squares approach, although regularization of the minimum norm solution can have particular benefit at low frequencies. It is also possible to refine further these solutions using regularization approached that promote sparse solutions. That is, the number of sources participating in the solutions is minimized. Full details of these approaches, including the algorithms used to implement them are described in Appendices 4 and 5. The application of these methods help to identify better the sources within the array that are most important to the process of ensuring that the required solution is delivered.

In summary, as described above the Optimal Source Distribution (OSD) is a symmetric distribution of pairs of point monopole sources whose separation varies continuously as a function of frequency in order to ensure at all frequencies a path length difference of one-quarter of an acoustic wavelength between the source pairs and the ears of a listener. The field of the OSD has a directivity function that is independent of frequency that in principle can produce cross-talk cancellation at a number of listener positions simultaneously over a wide frequency range. As demonstrated above we have shown that the problem of approximating the field of the OSD with a discrete number of transducers can be solved using either a minimum norm solution or a linearly constrained least squares approach. The minimum norm solution is effective in delivering cross-talk cancellation at the required field points with minimum source effort. The constrained least squares solution also delivers the required cross-talk cancellation at the required field points and tends also to produce a replica of the OSD sound field. Sparse solutions can also be beneficially used to better identify the most important sources required. The above embodiments allow multiple listeners to simultaneously experience virtual sound imaging from an array of speakers

APPENDIX 1. QR-FACTORISATION FOR THE DETERMINATION OF THE LINEARLY CONSTRAINED LEAST SQUARES SOLUTION

Using the definitions given in the main text, it can be shown that $$Bv = \left(Q\begin{bmatrix} R \\ 0 \end{bmatrix}\right)^H v = [R^H 0]Q^H v = [R^H 0]\begin{bmatrix} y \\ z \end{bmatrix} = R^H y \tag{A1.1}$$

Using the property $QQ^H=I$ also shows that $$Av = AQQ^H v = [A_1 A_2]\begin{bmatrix} y \\ z \end{bmatrix} = A_1 y + A_2 z \tag{A1.2}$$

This enables the problem to be transformed into a minimisation problem where one seeks to minimise $\|A_1y+A_2z-\hat{w}_A\|^2$ subject to $R^Hy=\hat{w}_B$. Then since $y=R^{H-1}\hat{w}_B$ the minimisation problem reduces to $$\min\|A_2z-(\hat{w}_A-A_1v)\|_2^2=\min\|A_2z-(\hat{w}_A-A_1R^{H-1}\hat{w}_B)\|_2^2 \tag{A1.3}$$

This can be solved for z to give the following solution for the optimal source strength vector $$v_{opt} = Q\begin{bmatrix} y_{opt} \\ z_{opt} \end{bmatrix} \tag{A1.4}$$

where the least squares solution to the minimisation problem involving the vector z can be written as $$z_{opt}=[A_2^H A_2]^{-1}A_2^H(\hat{w}_A-A_1R^{H-1}\hat{w}_B) \tag{A1.5}$$

and the modified constraint equation above gives $$y_{opt}=R^{H-1}\hat{w}_B \tag{A1.6}$$

Now note that this solution can be written explicitly in terms of the optimal vector of source strengths by partitioning of the matrix Q such that $$v_{opt}=Q_1y_{opt}+Q_2z_{opt} \tag{A1.7}$$

Also writing the pseudo inverse of matrix $A_2$ as $[A_2^H A_2]^{-1}A_2^H=A_2^\dagger$, enables the solution to be written as $$v_{opt}=Q_1R^{H-1}\hat{w}_B+Q_2A_2^\dagger(\hat{w}_A-A_1R^{H-1}\hat{w}_B) \tag{A1.8}$$

and therefore as $$v_{opt}=Q_2A_2^\dagger\hat{w}_A+(Q_1R^{H-1}-Q_2A_2^\dagger A_1R^{H-1})\hat{w}_B \tag{A1.9}$$

APPENDIX 2. USE OF THE CONSTRAINED LEAST SQUARES SOLUTION TO SPECIFY A DESIRED RADIATION PATTERN

It is interesting to note that there may be other possibilities for the specification of the reproduced signals $\hat{w}_A$ other than the radiation pattern associated with the OSD. Thus note that the expression for the optimal source strength vector given above can be written as $$v_{opt}=X\hat{w}_B+Y\hat{w}_A \tag{A2.1}$$

where the matrices X and Y are respectively defined by $$X=Q_1R^{H-1}+Q_2A_2^\dagger A_1R^{H-1},\ Y=Q_2A_2^\dagger \tag{A2.2}$$

The effort made by the acoustic sources, given by $\|v\|_2^2$, can be written as $$\|v_{opt}\|_2^2=v_{opt}^Hv_{opt}=(X\hat{w}_B+Y\hat{w}_A)^H(X\hat{w}_B+Y\hat{w}_A) \tag{A2.3}$$

which when expanded shows that $$\|v_{opt}\|_2^2=v_{opt}^Hv_{opt}=\hat{w}_A^HY^HY\hat{w}_A+\hat{w}_A^HY^HX\hat{w}_B+\hat{w}_B^HX^HX\hat{w}_B+\hat{w}_B^HX^HY\hat{w}_A \tag{A2.4}$$

which is a quadratic function of $\hat{w}_A$ minimised by $$\hat{w}_A=-[Y^HY]^{-1}Y^HX\hat{w}_B \tag{A2.5}$$

It would therefore be useful to compute these values of the signals at the radiated field points that ensures that the source effort (as exemplified by the sum of squared magnitudes of the source strengths) is minimised, whilst still ensuring that the constraint is satisfied. The feasibility and results of such a computation will of course depend on the properties of the matrices X and Y.

APPENDIX 3. THE LINEARLY CONSTRAINED LEAST SQUARES SOLUTION USING THE METHOD OF LAGRANGE MULTIPLIERS

Another method for determining the solution to $$\min\|Av-\hat{w}_A\|_2^2 \text{ subject to } \hat{w}_B=Bv \tag{A3.1}$$

is to use the method of Lagrange multipliers, which is widely used in the solution of constrained optimisation problems. The analysis presented here is similar to that presented previously by Olivieri et al [10] and by Nelson and Elliott [8]. The analysis begins by defining a cost function J given by $$J=(Av-\hat{w}_A)^H(Av-\hat{w}_A)+(Bv-\hat{w}_B)^H\mu+\mu^H(Bv-\hat{w}_B)+\beta v^Hv \tag{A3.2}$$

where μ is a complex vector of Lagrange multipliers and the term $\beta v^Hv$ is included, as will become apparent, in order to regularise the inversion of a matrix in the solution. The derivatives of this function with respect to both v and μ are defined by $$\frac{\partial J}{\partial v} = \frac{\partial J}{\partial v_R} + j\frac{\partial J}{\partial v_I},\ \frac{\partial J}{\partial \mu} = \frac{\partial J}{\partial \mu_R} + j\frac{\partial J}{\partial \mu_I} \tag{A3.3}$$

where $v=v_R+jv_1$ and $\mu=\mu_R+j\mu_1$. The following identities can be deduced from the analysis presented by Nelson and Elliott [8] (see the Appendix):

$$\frac{\partial}{\partial x}(x^H Gx) = 2Gx,\ \frac{\partial}{\partial x}(x^H b + b^H x) = 2b \tag{A3.4a, b}$$

Expanding the first term in the above expression for the cost function J gives $$J=v^H A^H Av-v^H A^H \hat{w}_A-\hat{w}_A{}^H Av+\hat{w}_A{}^H \hat{w}_A+(Bv-\hat{w}_B)^H \mu+\mu^H (Bv-\hat{w}_B)+\beta v^H v \tag{A3.5}$$

and using the above identities shows that the minimum in the cost function is given by $$\frac{\partial J}{\partial v} = 2A^H Av - 2A^H \hat{w}_A + 2B^H \mu + 2\beta v = 0 \tag{A3.6}$$

$$\frac{\partial J}{\partial \mu} = Bv - \hat{w}_B = 0 \tag{A3.7}$$

Note that these equations can also be written in matrix form as $$\begin{bmatrix} A^H A & B^H \\ B & 0 \end{bmatrix}\begin{bmatrix} v \\ \mu \end{bmatrix} = \begin{bmatrix} A^H \hat{w}_A \\ \hat{w}_B \end{bmatrix} \tag{A3.8}$$

and are sometimes known as the Karush-Kuhn-Tucker (KKT) conditions. Rearranging the first of these equations shows that $$[A^H A+\beta I]v=A^H \hat{w}_A-B^H \mu \tag{A3.9}$$

and therefore $$v=[A^H A+\beta I]^{-1}(A^H \hat{w}_A-B^H \mu) \tag{A3.10}$$

The above relationship can be solved for the vector μ of Lagrange multipliers by using $Bv=\hat{w}_B$ so that $$B[A^H A+\beta I]^{-1}(A^H \hat{w}_A-B^H \mu)=\hat{w}_B \tag{A3.11}$$

Further manipulation can be simplified by defining the following expressions:

$$A^\dagger=[A^H A+\beta I]^{-1}A^H,\ \text{and}\ \tilde{A}=[A^H A+\beta I]^{-1} \tag{A3.12a,b}$$

These enable the above equation to be written as $$BA^\dagger \hat{w}_A-B\tilde{A}B^H \mu=\hat{w}_B \tag{A3.13}$$

It then follows that the expression for the vector of Lagrange multipliers can be written as $$\mu=[B\tilde{A}B^H]^{-1}(BA^\dagger \hat{w}_A-\hat{w}_B) \tag{A3.14}$$

Substituting this into the expression for the source strength vector yields the optimal value given by $$v_{opt}=A^\dagger \hat{w}_A-\tilde{A}B^H[B\tilde{A}B^H]^{-1}(BA^\dagger \hat{w}_A-\hat{w}_B) \tag{A3.15}$$

A little rearrangement shows that this expression can also be written as $$v_{opt}=[I-\tilde{A}B^H[B\tilde{A}B^H]^{-1}B]A^\dagger \hat{w}_A+\tilde{A}B^H[B\tilde{A}B^H]^{-1}\hat{w}_B \tag{A3.16}$$

It is worth noting that in the absence of the linear constraint, such that $B\hat{w}_B=0$, then the solution reduces to the usual regularised least squares solution $$v_{opt}=A^\dagger \hat{w}_A=[A^H A+\beta I]^{-1}A^H \hat{w}_A \tag{A3.17}$$

APPENDIX 4. SPARSE SOLUTIONS USING ONE NORM REGULARISATION

In making use of the above solutions, it may be helpful to encourage so called "sparse" solutions that reflect the desirability of using a number of loudspeakers that is as small as possible in order to deliver the desired result. Considerable work in recent years has been aimed at the solution of such problems, one approach to which is the introduction of a term into the cost function to be minimised that, in this case, is proportional to the one norm of the vector v whose solution is sought. The one norm of the vector is defined by $$\|v\|_1=\Sigma_{m=1}^{M}|v_m| \tag{A4.1}$$

where $|v_m|$ is the modulus of the m'th element of the complex vector v. The introduction of such a term gives a cost function whose minimisation is known to promote a sparse solution, a typical example of which is the "least absolute shrinkage and selection operator" (LASSO) [11], which in terms of the current variables of interest, can be written in the form $$\min[\tfrac{1}{2}\|\tilde{C}v-\tilde{w}\|_2{}^2+v\|v\|_1] \tag{A4.2}$$

where the matrix $\tilde{C}$ and vector $\tilde{w}$ are used to represent the terms in the linearly constrained least squares solution given in section 6 above, and v is a parameter that is used to trade off the accuracy of the solution against its sparsity. It is worth noting that whilst the term $\|v\|_1$ itself is not differentiable (where the elements of v are equal to zero), and thus the usual apparatus for the analytical solution of such minimisation problems is not available, the function is nonetheless convex and has a unique minimum. There are many algorithms available to solve this problem when the variables involved are real (see for example, [12]) although less work has been done on the case where the variables are complex (see [13-15] for some examples in the complex case).

A technique that has become popular in recent years for finding the minimum of the above cost function is to use so-called proximal methods [16]. These are particularly suited to problems where the dimensionality is large, although the simplicity of the algorithms involved make them more generally attractive. Note that the function to be minimised can be written as $$\min F(v)=[\tfrac{1}{2}\|\tilde{C}v-\tilde{w}\|_2{}^2+v\|v\|_1]=f(v)+g(v) \tag{A4.3}$$

where f(v) and g(v) are respectively the two-norm and one-norm terms. First consider the minimisation of f(v). The proximal operator for a given function f(v) is defined as [16]

$$prox_f(z) = \text{argmin}\left[\frac{1}{2\tau}\|v-z\|_2^2 + f(v)\right] \tag{A4.4}$$

where this function effectively defines a compromise between minimising f(v) and being near to the point z, and the parameter τ in this case is used to quantify the compromise. The minimum of this function can be found easily analytically, and using the definition of the gradient of these functions with respect to the complex vector v, together with other results in Appendix 3, shows that $$\frac{\partial}{\partial v}\left[\frac{1}{2\tau}\|v-z\|_2^2+\frac{1}{2}\|\tilde{C}v-\tilde{w}\|_2^2\right]=\frac{1}{\tau}(v-z)+\tilde{C}^H(\tilde{C}v-w)=\frac{1}{\tau}(v-z)+\nabla f(v) \quad (A.4.5)$$

where the gradient of the function $\nabla f(v)=\tilde{C}^H(\tilde{C}v-w)$. Equating this result for the gradient to zero shows that $v=z-\tau\nabla f(v)$ and that the proximal operator can be written as $$\text{prox}_f(z)=z-\tau\nabla f(v) \quad (A4.6)$$

In this case the "proximal algorithm" for finding the minimum of the function is simply an expression of the gradient descent method (the "proximal gradient method") where the (k+1)'th iteration for finding the minimum is expressed as $$v^{k+1}=v^k-\tau\nabla f(v^k) \quad (A4.7)$$

Whilst the minimisation of the function $f(v)$ via proximal methods appears trivial, the minimisation of the function $g(v)=v\|v\|_1$ is less straightforward. Nonetheless, despite the lack of differentiability of the function, it is possible to derive an appropriate proximal operator [16]. In the case of a real vector variable, the proximal operator is the "soft thresholding" operator applied to each (real) element $z_i$ of the (real) vector z in turn:

$$prox_\alpha(z_m)=S_\alpha(z_m)=\begin{cases} z_m-v & \text{if } z_m\geq v \\ 0 & \text{if } |z_m|\leq v \\ z_m+v & \text{if } z_m\leq -v \end{cases} \quad (A4.8)$$

This operator is often referred to as the "shrinkage operator" and can also be written compactly in the form $$S_\alpha(z_m)=\begin{cases} \text{sgn}(z_m)(|z_m|-v) & \text{if } z_m\geq v \\ 0 & \text{otherwise} \end{cases} \quad (A4.9)$$

where $\text{sgn}(z_m)=z_m/|z_m|$ is the sign operator. It turns out that, when written in this form, the same shrinkage operator is applicable to complex vectors where $|z_m|$ is the modulus of the complex number $z_m$. A full derivation of this proximal operator in the case of complex variables is given by Maleki et al [16] and has been used by a number of other authors in finding solutions to what is effectively the complex LASSO problem (see for example [14, 15]).

A particular algorithm for minimising the function $F(v)=f(v)+g(v)$ that makes use of the two proximal operators given above is known as the "iterative soft-thresholding algorithm" (ISTA)[17]. This can be written in the form of a two "half step" process using each of the iterations above such that $$v^{k+1/2}=v^k-\tau\nabla f(v^k) \quad (A4.10)$$

$$v^{k+1}=S_\alpha(v^{k+1/2}) \quad (A4.11)$$

However, the algorithm is very often compactly written in the form of a single operation given by $$v^{k+1}=S_{\tau\alpha}(v^k-\tau\nabla f(v^k)) \quad (A4.12)$$

where the threshold in the above shrinkage operator is given by the product of $\alpha$ and $\tau$. The algorithm is sometimes referred to as a "forward-backward splitting algorithm", given that it implements a forward gradient step on $f(v)$, followed by a backward step on $g(v)$. It has also been shown that the speed of convergence of this algorithm can be greatly enhanced by some simple modifications to the step size. This results in the "fast iterative shrinkage-thresholding algorithm" (FISTA) [18].

APPENDIX 5. SPARSE SOLUTIONS USING "ZERO NORM" REGULARISATION

A very similar algorithm to that described above has been derived in order to further promote sparsity of the solution through the addition of a term proportional to the "zero norm" of the vector v. This is simply the number of non-zero elements of the vector and can be written as $\|v\|_0$. The cost function for minimisation in this case can be written in the form $$\min[\|\tilde{C}v-\tilde{w}\|_2^2+p\|v\|_0] \quad (A5.1)$$

Whilst the LASSO function described above is known to have a unique minimum, it is also known that this cost function, including the zero norm term, does not have a uniquely defined minimum. Nonetheless a very compact and useful algorithm has been derived by Blumensath and Davies[19, 20] that will find local minima in this cost function using a similar approach to that described above. In this case, the algorithm is known as an "iterative hard-thresholding algorithm" and has the form $$v^{k+1}=H_\rho(v^k-\nabla f(v^k)) \quad (A5.2)$$

where $\nabla f(v^k)=\tilde{C}^H(\tilde{C}v-w)$ and $H_\rho$ is the hard-thresholding operator defined by $$H_\rho=\begin{cases} 0 & \text{if } |v^k|\leq\rho^{0.5} \\ v^k & \text{if } |v^k|>\rho^{0.5} \end{cases} \quad (A5.3)$$

A further useful algorithm has been derived [19] that provides a means of finding at least local minima in the cost function defined by $$\min[\|\tilde{C}v-\tilde{w}\|_2^2+\|v\|_0\leq M] \quad (A5.4)$$

where M defines a desired upper bound on the number of non-zero elements of the vector v. The appropriate algorithm in this case is given by $$v^{k+1}=H_M(v^k-\nabla f(v^k)) \quad (A5.5)$$

where $H_M$ is a non-linear operator that only retains the M coefficients with the largest magnitude defined by $$H_M=\begin{cases} 0 & \text{if } |v^k|<\rho_M^{0.5}(v) \\ v^k & \text{if } |v^k|\geq\rho_M^{0.5}(v) \end{cases} \quad (A5.6)$$

In this case, the threshold $\rho_M^{0.5}(v)$ is set to the largest absolute value of $v^k-\tilde{C}^H(\tilde{C}v^k-w)$ and if less than M values are non-zero, $\rho_M^{0.5}(v)$ is defined to be the smallest absolute value of the non-zero coefficients. This algorithm was described by its originators as the "M-sparse algorithm"[19] and provides another means of finding a solution that limits the number of loudspeakers required to meet the objective of replicating the desired sound field.

Accepting that only local minima may be identified in the cost functions involving the "zero norm", it may assist in the search for good solutions by repeating the iterative search processes with a range of initial conditions. Other techniques such as simulated annealing [21] may be used in an "outer loop" to the above algorithms that should enable a controlled statistically based search process that prevents such algorithms from becoming trapped in local minima.

REFERENCES

1. Takeuchi, T. and P. A. Nelson, *Optimal source distribution for binaural synthesis over loudspeakers*. J Acoust Soc Am, 2002. 112(6): p. 2786-97.
2. Takeuchi, T., M. Teschl, and P. A. Nelson, *Objective and subjective evaluation of the optimal source distribution for virtual acoustic imaging*. Journal of the Audio Engineering Society 2007. 55(11): p. 981-987.
3. Morgan, D. G., T. Takeuchi, and K. R. Holland, *Off-axis cross-talk cancellation evaluation of 2-channel and 3-channel OPSODIS soundbars*, in *Reproduced Sound* 2016. 2016, Proceedings of the Institute of Acoustics: Southampton.
4. Haines, L. A. T., T. Takeuchi, and K. R. Holland, *Investigating multiple off-axis listening positions of an OPSODIS sound bar*, in *Reproduced Sound* 2017 *Nottingham*. 2017, Proceedings of the Institute of Acoustics.
5. Yairi, M., et al., *Off-axis cross-talk cancellation evaluation of Optimal Source Distribution*, in *Institute of Electronics Information and Communication Engineers (IEICE) Japan EA ASJ-H ASJ-AA*. 2018: Hokkaido University. p. 115-120.
6. Takeuchi, T. and P. A. Nelson, *Extension of the Optimal Source Distribution for Binaural Sound Reproduction*. Acta Acustica united with Acustica, 2008. 94(6): p. 981-987.
7. Yairi, M., et al., *Binaural reproduction capability for mutiple off-axis listeners based on the 3-channel optimal source distribution principle*, in *23rd International Congress on Acoustics*. 2019: Aachen, Germany.
8. Nelson, P. A. and S. J. Elliott, *Active Control of Sound*. 1992, London: Academic Press.
9. Golub, G. and C. Van Loan, *Matrix Computations*. 1996, London: The John Hopkins University Press.
10. Olivieri, F., et al., *Comparison of strategies for accurate reproduction of a target signal with compact arrays of loudspeakers for the generation of private sound and silence*. Journal of the Audio Engineering Society, 2016. 64(11): p. 905-917.
11. Tibshirani, R., *Regression shrinkage and selection via the Lasso*. Roy. Stat. Soc. Ser. B, 1996. 58(1): p. 267-288.
12. Boyd, S. and L. Vandenberghe, *Convex optimisation*. 2004, New York: Cambridge University Press.
13. Maleki, A., et al., *Asymptotic Analysis of Complex LASSO via Complex Approximate Message Passing (CAMP)*. IEEE Transactions on Information Theory, 2013. 59(7): p. 4290-4308.
14. Hald, J., *A comparison of iterative sparse equivalent source methods for near-field acoustical holography*. J Acoust Soc Am, 2018. 143(6): p. 3758.
15. Alqadah, H. F., N. Valdivia, and E. G. Williams, *A Super-Resolving Near-Field Electromagnetic Holographic Method*. IEEE Transactions on Antennas and Propagation, 2014. 62(7): p. 3679-3692.
16. Parikh, N. and S. Boyd, *Proximal Algorithms*. Foundations and Trends in Optimisation. 2013, Delft: now Publishers Inc.
17. Daubechies, I., M. Defrise, and C. De Mol, *An iterative thresholding algorithm for linear inverse problems with a sparsity constraint*. Communications on Pure and Applied Mathematics, 2004. LVII: p. 1413-1457.
18. Beck, A. and M. Teboulle, *A Fast Iterative Shrinkage-Thresholding Algorithm for Linear Inverse Problems*. SIAM Journal on Imaging Sciences, 2009. 2(1): p. 183-202.
19. Blumensath, T. and M. E. Davies, *Iterative Thresholding for Sparse Approximations*. Journal of Fourier Analysis and Applications, 2008. 14(5-6): p. 629-654.
20. Blumensath, T. and M. E. Davies, *Iterative hard thresholding for compressed sensing*. Applied and Computational Harmonic Analysis, 2009. 27(3): p. 265-274.
21. Du, K.-L. and M. N. S. Swamy, *Search and Optimisation by Metaheuristics*. 2016, Switzerland: Springer.

The invention claimed is:

1. A sound reproduction apparatus comprising a signal processor arranged to perform processing of a sound recording so as to provide input signals for an array of distributed discretised loudspeakers, such that the sound field generated by the loudspeakers results in cross-talk cancellation in respect of multiple listener positions at substantially all frequencies reproduced by the loudspeakers, wherein the sound field so generated is the result of an approximation solution for a sound field produced by an Optimal Source Distribution, OSD, and wherein the signal processor is configured to determine the approximation solution using one of a least squared errors solution and a minimum norm solution.

2. A sound reproduction apparatus as claimed in claim 1 in which the least squared errors solution comprises the solution to a linearly constrained least squares problem.

3. A sound reproduction apparatus as claimed in claim 1 in which the solution is configured to minimize a sum of squared errors between the desired sound field and the sound field which is reproduced.

4. A sound reproduction apparatus as claimed in claim 1 in which the solution comprises a least squares solution with an equality constraint.

5. A sound reproduction apparatus as claimed in claim 4 in which the solution comprises a solution of an unconstrained least squares problem.

6. A sound reproduction apparatus as claimed in claim 2 in which the solution comprises use of QR factorization.

7. A sound reproduction apparatus as claimed in claim 2 in which the solution comprises use of Lagrange multipliers.

8. A sound reproduction apparatus as claimed in claim 2 in which the positioning of virtual sampling points in the sound field are chosen such that a conditioning number of a transmission path matrix is minimized or diminished.

9. A sound reproduction apparatus as claimed in claim 1 in which the signal processor is configured to generate a vector of loudspeaker input signals.

10. A sound reproduction apparatus as claimed in claim 1 which is configured to perform processing which comprises a sparse solution in which the number of loudspeakers required to achieve the sound field is minimized.

11. A sound reproduction apparatus as claimed in claim 10 which comprises a solution to the complex LASSO problem.

12. A sound reproduction apparatus as claimed in claim 10 in which the sparse solution comprises use of a soft-thresholding algorithm or a hard-thresholding algorithm.

13. A sound reproduction apparatus as claimed in claim 10 which comprises use of an annealing algorithm.

14. A sound reproduction apparatus as claimed in claim 1 in which at each listener position there is a pair of sound field points, each point intended for a respective listener ear.

15. A sound reproduction apparatus as claimed in claim 1 in which the multiple listener positions are located on a line or in an arc in the sound field.

16. A sound reproduction apparatus as claimed in claim 1 which comprises a filter set which at least in part implements the processing of the sound recording.

17. A sound reproduction apparatus as claimed in claim 1 in which the sound field generated is an approximation of either a two channel OSD or that of a three channel OSD.

18. A sound reproduction system comprising the sound reproduction apparatus of claim 1 and an array of loudspeakers.

19. Non-transitory computer readable medium comprising machine-readable instructions which when executed by a data processor are configured to implement the processing of signal processor as claimed in claim 1.

* * * * *